US010299561B2

(12) United States Patent
Maruyama et al.

(10) Patent No.: US 10,299,561 B2
(45) Date of Patent: May 28, 2019

(54) MAKEUP TOOL

(71) Applicant: MITSUBISHI PENCIL COMPANY, LIMITED, Tokyo (JP)

(72) Inventors: Seiichi Maruyama, Gunma (JP); Shigeki Ooba, Gunma (JP); Hisami Tamano, Gunma (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/194,702

(22) Filed: Jun. 28, 2016

(65) Prior Publication Data

US 2016/0374453 A1 Dec. 29, 2016

(30) Foreign Application Priority Data

Jun. 29, 2015 (JP) ..... 2015-129867
Mar. 14, 2016 (JP) ..... 2016-050071

(51) Int. Cl.
*A45D 34/04* (2006.01)
*A45D 40/20* (2006.01)

(52) U.S. Cl.
CPC ..... *A45D 34/04* (2013.01); *A45D 40/20* (2013.01)

(58) Field of Classification Search
CPC ..... A45D 34/04; A45D 40/26; B43K 8/02; B43K 8/022; B43K 8/024; B43K 8/026; B43K 1/006; B43K 1/12
See application file for complete search history.

(56) References Cited

U.S. PATENT DOCUMENTS 3,459,483 A * 8/1969 Brastad ..... B43K 8/026 401/131
3,481,677 A * 12/1969 Abrahamson ..... B43K 8/02 401/131
4,208,145 A * 6/1980 Azuma ..... B43K 1/003 401/196
4,453,849 A * 6/1984 Fernandez ..... B43K 3/02 33/41.6
D449,071 S * 10/2001 Kirita ..... D19/200
(Continued)

FOREIGN PATENT DOCUMENTS

FR 2758496 7/1998
JP H07205583 8/1995
(Continued)

OTHER PUBLICATIONS

Preliminary Search Report of the National Institute of Industrial Property for Corresponding French Application FR1656035 dated Feb. 26, 2019.

*Primary Examiner* — David P Angwin
*Assistant Examiner* — Bradley S Oliver
(74) *Attorney, Agent, or Firm* — Renner Otto Boisselle & Sklar, LLP

(57) ABSTRACT

To provide a makeup tool that is excellent in design and can perform stable application of a cosmetic, the makeup tool includes a barrel cylinder storing the cosmetic; and an application part attached to one end of the barrel cylinder, in which the application part includes an applying element capable of feeding the cosmetic from the barrel cylinder to apply the cosmetic, and a retainer that holds the applying element, and the retainer is formed of a hard material presenting visibility.

4 Claims, 24 Drawing Sheets

(56) References Cited

U.S. PATENT DOCUMENTS

| | | | | |
|---|---|---|---|---|
| 6,659,672 | B1 * | 12/2003 | Kirita | B43K 1/00 401/192 |
| 7,147,394 | B2 * | 12/2006 | Mock | B43K 8/003 401/192 |
| 8,764,335 | B2 | 7/2014 | Uehara | |
| 2008/0213031 | A1 * | 9/2008 | Castner | B43K 1/12 401/292 |
| 2009/0283033 | A1 * | 11/2009 | Akaishi | A45D 34/04 118/410 |
| 2009/0317172 | A1 * | 12/2009 | Bedhome | B43K 1/003 401/198 |
| 2013/0064595 | A1 * | 3/2013 | Kamitani | B43K 8/003 401/198 |
| 2015/0367672 | A1 * | 12/2015 | Kamitani | B43K 8/06 401/198 |
| 2017/0006998 | A1 * | 1/2017 | Liu | A45D 34/04 |
| 2017/0036478 | A1 * | 2/2017 | Yasumi | B43K 8/026 |
| 2018/0325237 | A1 * | 11/2018 | Caulier | A45D 34/041 |

FOREIGN PATENT DOCUMENTS

| | | |
|---|---|---|
| JP | 2007236961 | 9/2007 |
| JP | 2010042046 | 2/2010 |

* cited by examiner

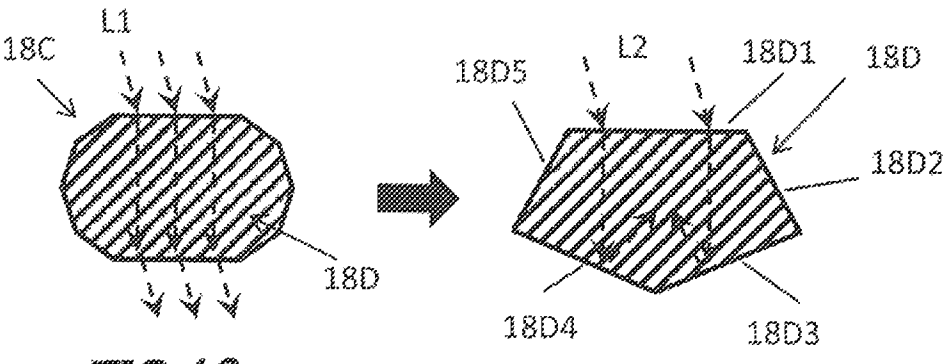
FIG. 13a
FIG. 13c
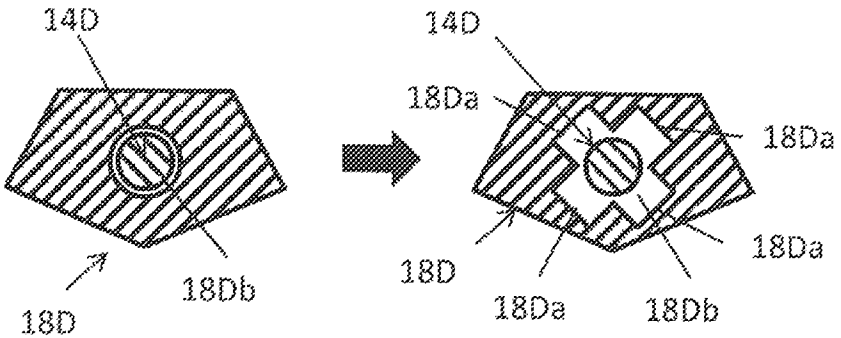
FIG. 13b
FIG. 13d
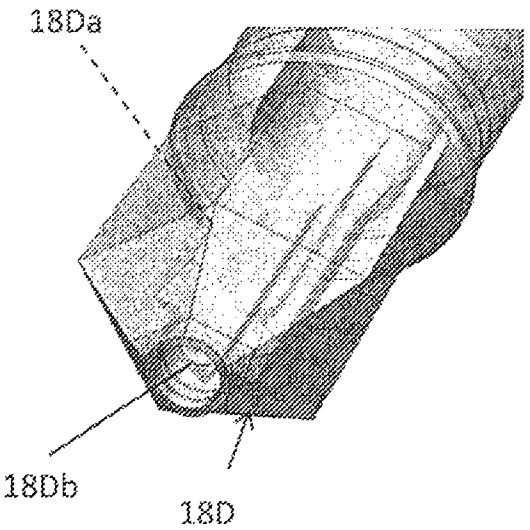
FIG. 13e

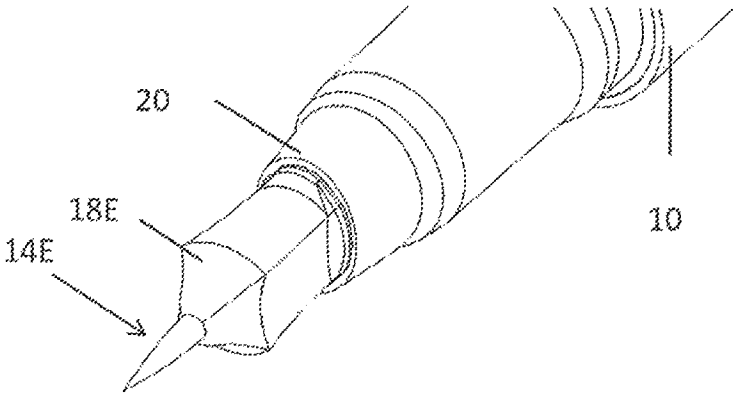
FIG. 14b
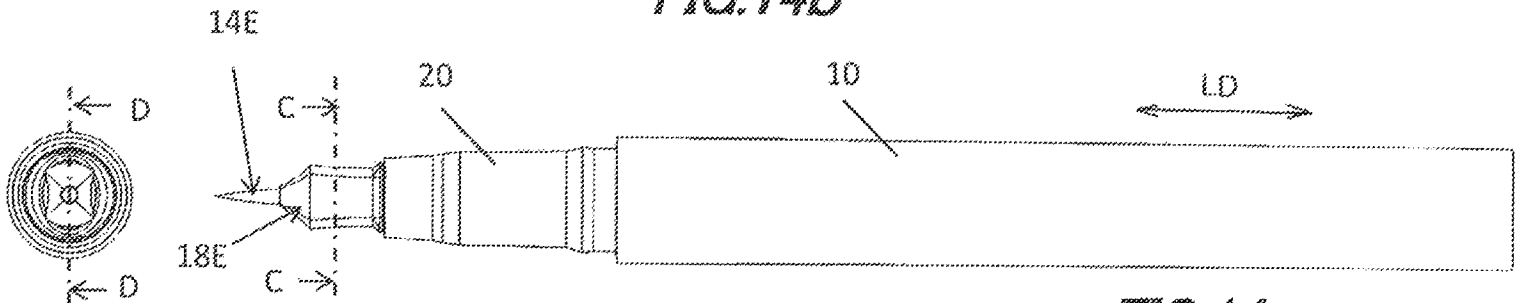
FIG. 14c
FIG. 14a
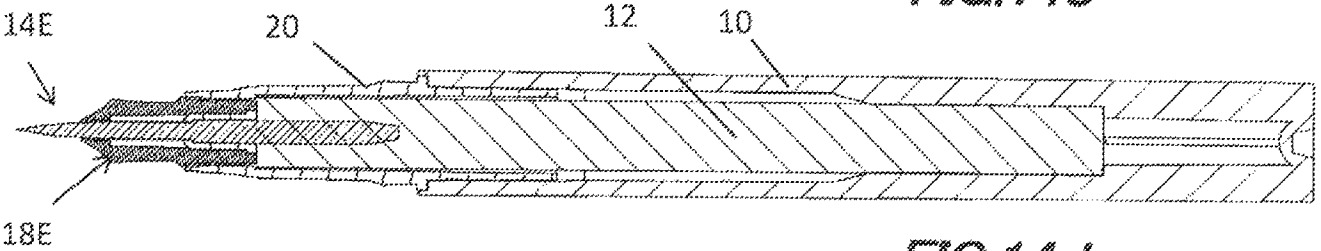
FIG. 14d

MAKEUP TOOL

This Nonprovisional application claims priority under 35 U.S.C. § 119(a) on Patent Application No. 2015-129867 filed in Japan on 29 Jun. 2015 and Patent Application No. 2016-50071 filed in Japan on 14 Mar. 2016, the entire contents of which are hereby incorporated by reference.

BACKGROUND OF THE INVENTION (1) Field of the Invention

The present invention relates to a makeup tool chat enables delivery and application of an application liquid from a container by means of an application part.

(2) Description of the Prior Art

In the field of makeup tools that applies cosmetics using brushes, fiber cores and other, conventionally, application performance has been considered important, whereas there have been few makeup tools than have good appearances from a design viewpoint.

Under such circumstances, there have been some disclosures of makeup tools that have a transparent or translucent applying element to secure visibility (see Patent Documents 1 and 2).

PRIOR ART DOCUMENTS

Patent Documents

[Patent Document 1]

Japanese Patent Application Laid-open No. 2007-236961

[Patent Document 2]

Japanese Patent Application Laid-open No. 2010-42046;

OUTLINE OF THE INVENTION

Problems to be Solved by the Invention

However, the inventions disclosed, by Patent Documents 1, 2 and others, the application part is formed to be visible, but the application part is formed of soft materials such as rubber or elastomer, hence cannot provide enough rigidity, which has given rise to the problem that stable cosmetic application cannot be achieved.

SUMMARY OF THE INVENTION

The present invention has been devised in view of what has been described above, it is therefore an object to provide a makeup tool that is excellent in design and still enables stable application of cosmetics.

Means for Solving the Problems

The present invention resides in a makeup tool comprising:

a barrel cylinder storing a cosmetic; and an application part attached to one and of the barrel cylinder, the application part comprising:

an applying element capable of feeding the cosmetic from the barrel cylinder to apply the cosmetic; and a retainer that holds the applying element, wherein the retainer is formed of a hard material presenting visibility.

It is preferable in the present invention that the applying element has a flat portion, a corner portion and a curved portion.

It is also preferable in the present invention that the retainer is arranged so as to surround the applying element, and raised and depressed ribs are arranged on an outer peripheral surface of the retainer.

It is also preferable in the present invention that when the applying element is provided for the retainer and the retainer is viewed from a particular angle, a ratio of a visible part of the applying element to a surface area of the retainer is equal to or less than 50%.

It is also preferable in the present invention that a thickest part in a cross section perpendicular to an axis direction of the retainer is equal to or greater than 1 mm, or a ratio between an outside diameter of the applying element and an outside diameter of the retainer is 1:3 or greater.

Advantages of the Invention

According to the makeup tool of the present invention, the application part includes an applying element capable of feeding the cosmetic from the barrel cylinder to apply the cosmetic, and a retainer that holds the applying element, and the retainer is formed of a hard material presenting visibility. Accordingly, this configuration can produce an excellent effect that when the user applies the cosmetic by holding the makeup tool by hand, the user can put on makeup while looking the target position to be applied, thanks to the visibility of the retainer.

BRIEF DESCRIPTION OF THE DRAWINGS

FIG. 8*g* a perspective view from the rear, and FIG. 8*h* a view from the rear;

FIGS. 13*a* to 13*e* show light paths through supporting members (retainers), FIG. 13*a* showing a transverse cross-sectional view of a supporting member according to the fourth embodiment, FIG. 13*b* a transverse cross-sectional view of a supporting member according to the fifth embodiment with no grooves (depressed portions) therein, FIG. 13*c* an illustrative diagram of light paths through the supporting member in FIG. 13*b*, FIG. 13*d* a transverse cross-sectional view of a supporting member according to the fifth embodiment with grooves (depressed portions), and FIG. 13*e* a perspective view showing the supporting member shown in FIG. 13*d*, in a see-through manner.

FIGS. 14*a* to 14*d* are illustrative diagrams of a makeup tool according to a sixth embodiment of the present invention, FIG. 14*a* showing a view from the front, FIG. 14*b* a perspective view from the front, FIG. 14*c* a front view, and FIG. 14*d* a vertical cross section cut along a plane D-D in FIG. 14*a;*

DESCRIPTION OF THE PREFERRED EMBODIMENTS

Embodiments of the present invention will hereinafter be described in detail with reference to the accompanying drawings. In any of the embodiments, a cap (not shown) for protecting the application part is removably attached to the front end of the barrel cylinder.

(Makeup Tool of the First Embodiment)

Figure 1A:
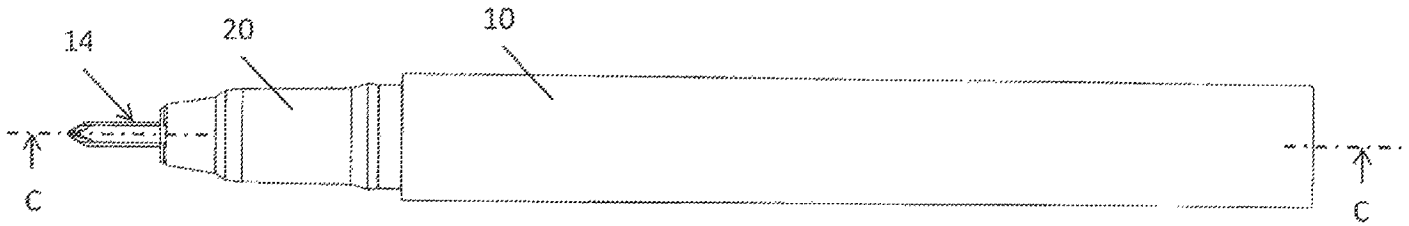
FIGS. 1*a* to 1*c* are illustrative diagrams of a makeup tool according to the first embodiment of the present invention, FIG. 1*a* showing a front view, FIG. 1*b* a front view rotated 90° from FIG. 1*a*, and FIG. 1*c* a vertical cross section cut along a plane C-C in FIG. 1*a;*
Figure 1B:
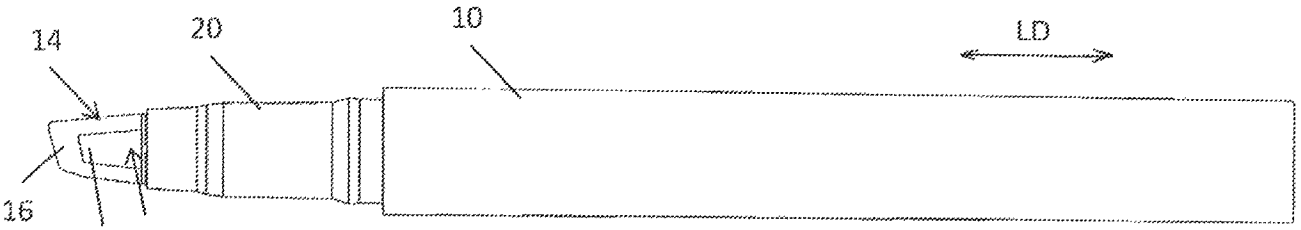
Figure 1C:
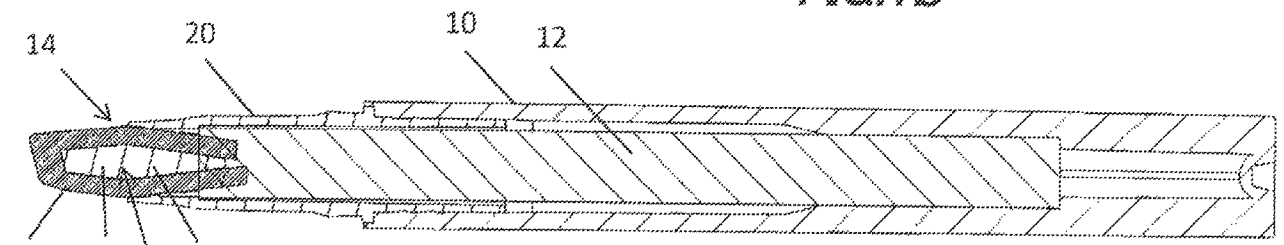

FIGS. 1*a*-1*c* are the illustrative diagram of the makeup tool according to the first embodiment of the present invention.

As shown in FIG. 1*c*, the makeup tool is constructed such that a cosmetic absorbent 12 is accommodated in a barrel cylinder 10 that forms the cosmetic main body, and the cosmetic absorbent 12 absorbs a liquid cosmetic. The barrel cylinder 10 has a cylindrical configuration closed at the rear end. Meanwhile, the reference letters LD in FIG. 1*b* indicates a longitudinal direction (axial direction) of the barrel cylinder 10.

The makeup tool is configured so that the cosmetic absorbent 12 is joined to the rear end of an application part 14 to supply the liquid cosmetic from the cosmetic absorbent 12 to the application part 14.

Figure 2B:
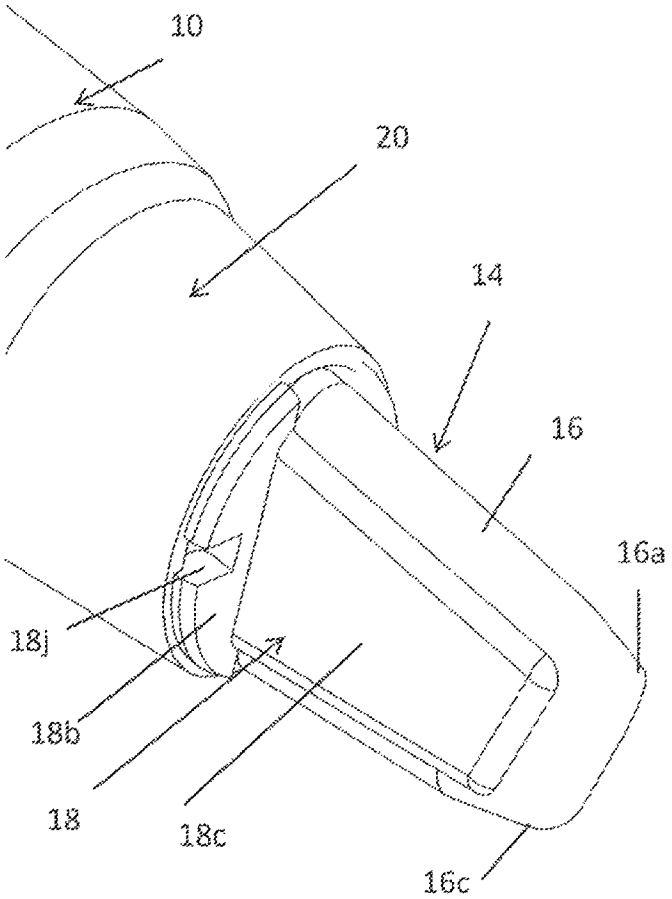
FIGS. 2*a* to 2*b* are enlarged diagrams of an application part in the makeup tool shown in FIGS. 1*a* to 1*c*, FIG. 2*a* showing a view from the front, and FIG. 2*b* a perspective view showing an application tip.
Figure 2A:
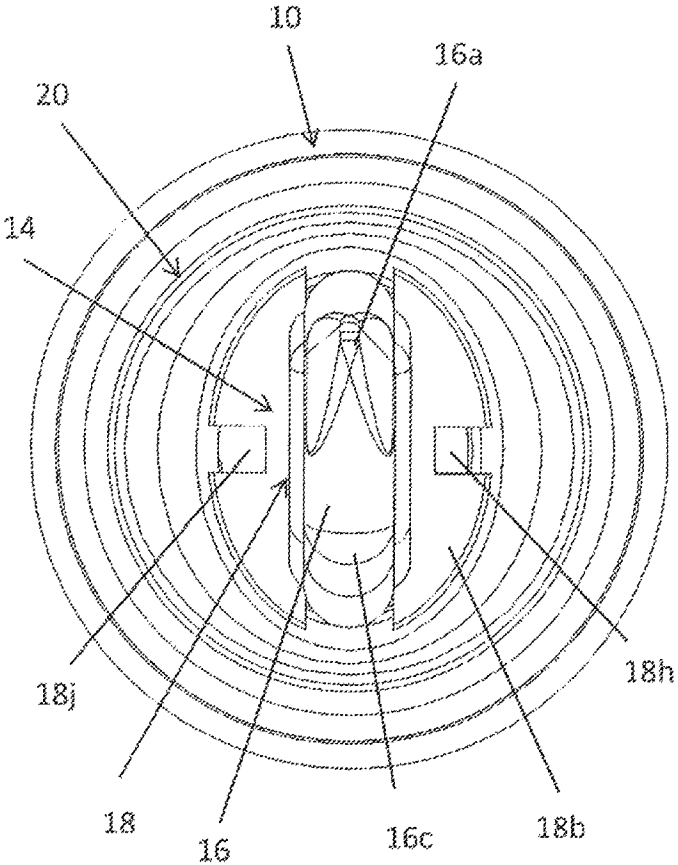

FIGS. 2*a*-2*b* are an enlarged view showing the application part 14 and its surroundings at the front end of the makeup tool. FIGS. 3*a*-3*h* and 4*a*-4*d* show a cosmetic feeder (corresponding to "applying element" or also called "writing core") 16. FIGS. 5*a*-5*h* are a part diagram of a support log member (corresponding to "retainer") 18 to which the cosmetic feeder 16 is attached.

The application part 14 of the first embodiment is constructed such that, as shown in FIGS. 2*a*-2*b*, the supporting member 13 supports the cosmetic feeder 16 that is laid out along the contour of the supporting member 18. The application part 14 that supports the cosmetic feeder 16 on the supporting member 18 is attached to the front end of the barrel cylinder 10 by the cylindrical front barrel 20.

When assembled, the application part 14 is laid out so that the cosmetic feeder 16 and supporting member 18 are projected and exposed approximately half from the front end of the front barrel 20. The front barrel 20 is attached to the front end of the barrel cylinder 10, and has a cylindrical form into which the front part of the cosmetic absorbent 12 is inserted. The interface between the front opening of the front barrel 20 and the application part 14 is closed by an aftermentioned flange 18*b* (with air communication channels 18*h* and 18*j* exposed) of the supporting member 18, and the main part 18*a* is fitted into the front end opening of the front barrel 20 so as to keep the application part 14 from coming off. The part (visible part 18*c*) of the main part 18*a* of the supporting member 18, around which the cosmetic feeder 16 is disposed, is transparent or translucent, so that the target to be applied can be seen therethrough.

The cosmetic absorbent 12 is impregnated with a fluid cosmetic material such as water-based cosmetics and the like, and may be a bundle formed of one kind of fiber or the combination of two or more kinds of fibers, selected from, for example, natural fiber, animal hair fiber, polyacetal resin, acrylic resin, polyester resin, polyamide resin, polyurethane resin, polyolefin resin, polyvinyl resin, polycarbonate resin, polyether resin, polyphenylene resin and the like, may be a fiber bundle product such as felt etc., or may be a porous material such as sponge, resin particles, sintered body, etc. The cosmetic absorbent 12 is accommodated inside the main body of the barrel cylinder 10. Here, the barrel cylinder 10 is closed at its rear end, however, may be sealed by a tail plug formed of the same material as the barrel cylinder 10 or another synthetic resin material, etc.

As shown in FIGS. 1*c* and 2*b*, the cosmetic feeder 16 has an approximately U-shape that encloses the supporting member 18 having an approximately rectangular shape.

Figure 3A:
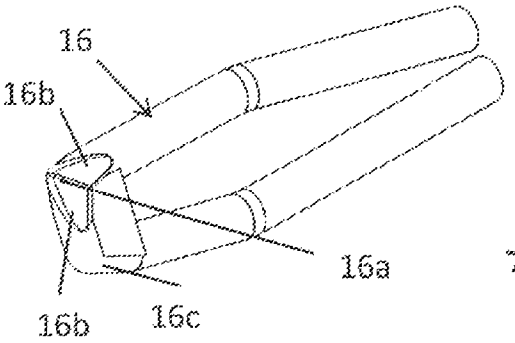
FIGS. 3*a* to 3*h* are part diagrams of a cosmetic absorbent in the application part of the makeup tool shown in FIGS. 1*a* to 1*c*, FIG. 3*a* showing a perspective view, FIG. 3*b* a view from the front, FIG. 3*c* a view from the top, FIG. 3*d* a front view from the side, FIG. 3*e* a cross sectional view cut along a plane E-E in FIG. 3*c*, FIG. 3*f* a view from the bottom, FIG. 3*g* a view from the rear, and FIG. 3*h* an enlarged perspective view of the tip.
Figure 3C:
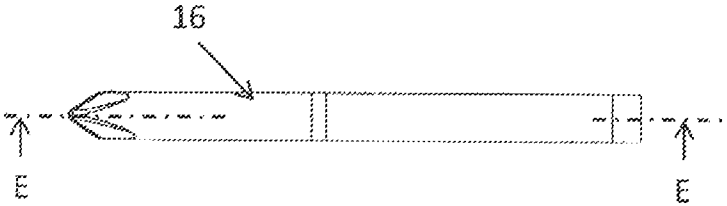
Figure 3D:
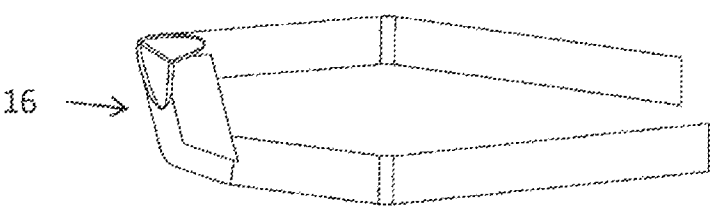
Figure 3B:
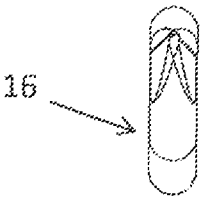
Figure 3G:
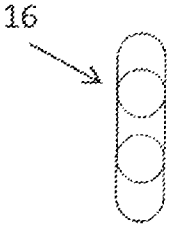
Figure 3H:
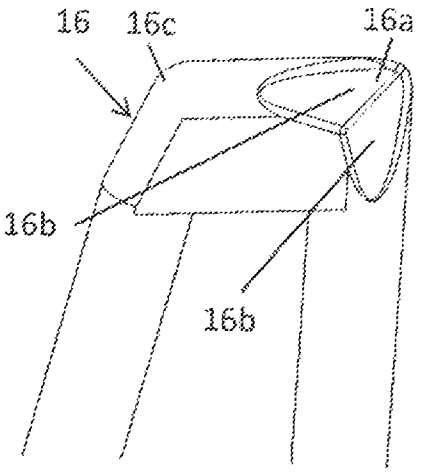
Figure 3E:
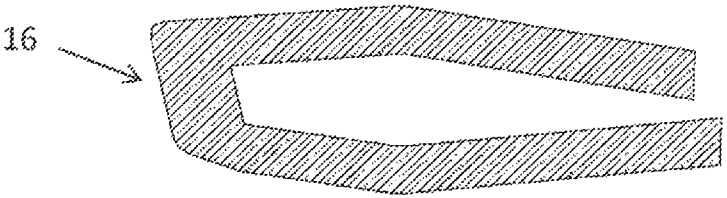
Figure 3F:
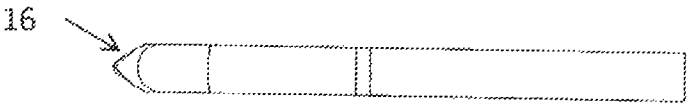

Further, in the first embodiment, the cosmetic feeder 16 has flat portions 16*b*, a corner 16*a* and a curved portion 16*c*, as shown in FIG. 3*a*. The cosmetic feeder 16 is a liquid-feeding sintered body formed of an appropriately bent strip that has an approximately circular cross section.

Then, the cosmetic feeder 16 is bent on the front side approximately 90° at two places where the corner 16*a* and curved portion 16*c* are formed. Formed along the corner 16*a* are four cut-off flat portions 16*b*. The boundaries of each flat portion 16*b* and connecting portions of flat portion 16*b* are beveled with a radius R of about 0.2 mm. The cosmetic feeder 16 is formed with the curved portion 16*c* that is radially curved. The front end of the cosmetic feeder 16 (the section between the corner 16*a* and curved portion 16*c*) has an atypical transverse cross section while the other part from the center to the rear has a circular transverse cross section.

Figure 4A:
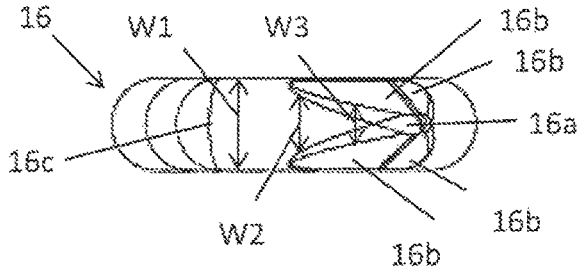
FIGS. 4*a* to 4*d* are illustrative diagrams of individual parts of the cosmetic absorbent in the application part of the makeup tool shown in FIGS. 1*a* to 1*c*, FIG. 4*a* showing a view from the front, FIG. 4*b* an enlarged view from the side, FIG. 4*c* an enlarged perspective view of flat portions and their surroundings, and FIG. 4*d* a front view from the side of flat portions.
Figure 4B:
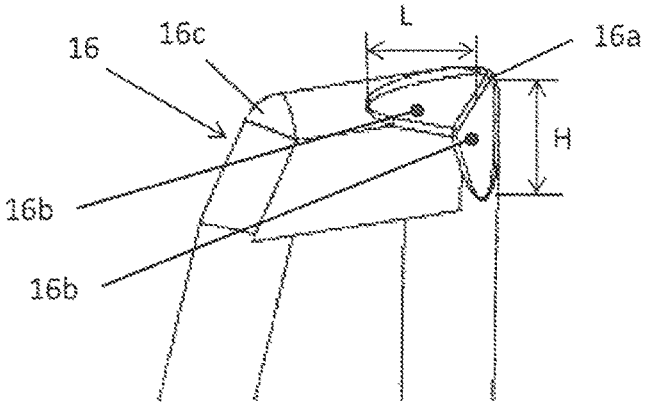
Figure 4C:
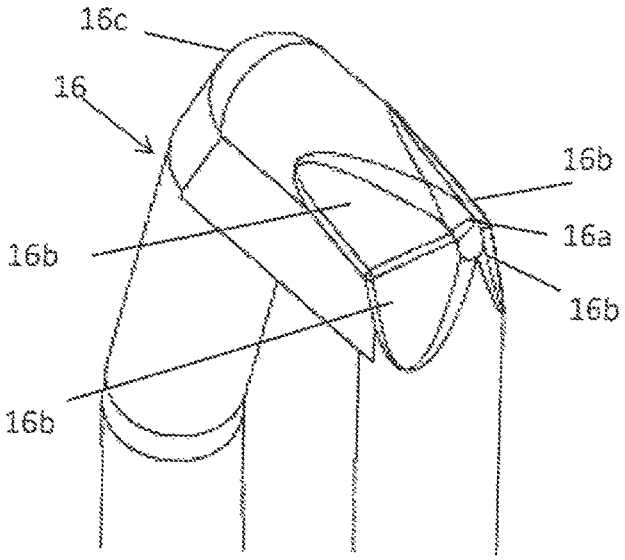
Figure 4D:
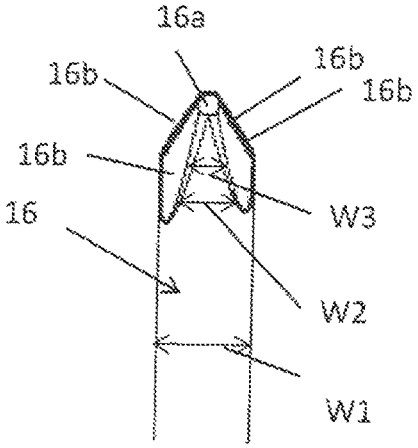
Figure 5G:
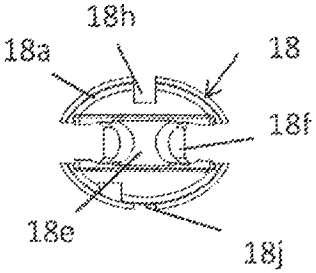
FIGS. 5*a* to 5*h* are part diagrams of a supporting member (retainer) in the makeup tool according to the first embodiment, FIG. 5*a* showing a view from the front, FIG. 5*b* a perspective view from the front, FIG. 5*c* a front view, FIG. 5*d* a plan view, FIG. 5*e* a rear view, FIG. 5*f* a vertical cross section cut along a plane F-F in FIG. 5*d,* FIG. 5*g* a view from the rear, and FIG. 5*h* a perspective view from the rear.
Figure 5C:
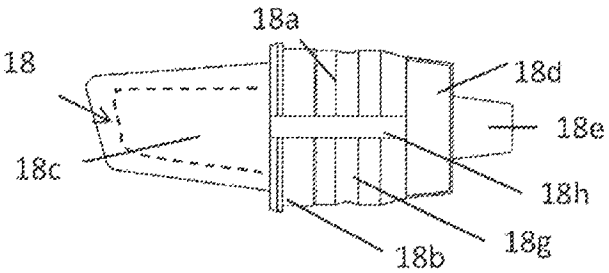
Figure 5D:
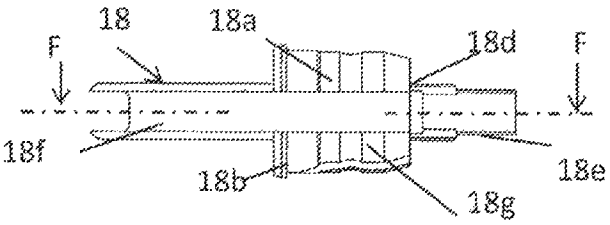
Figure 5E:
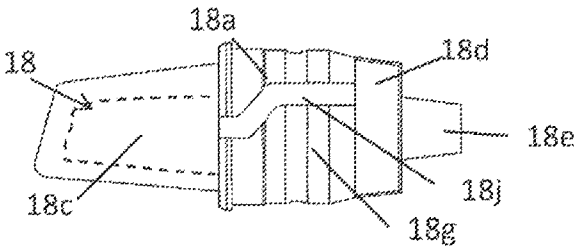
Figure 5A:
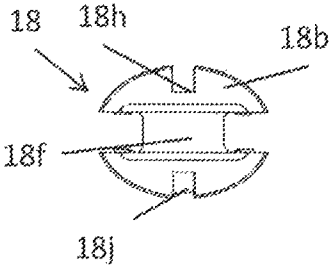
Figure 5H:
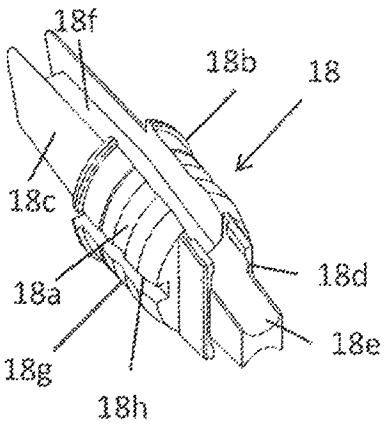
Figure 5F:
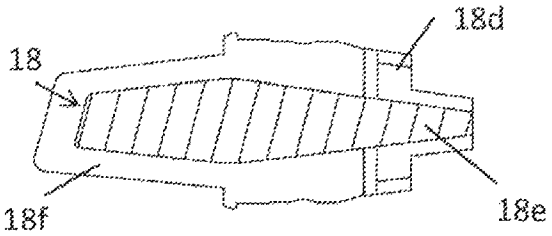
Figure 5B:
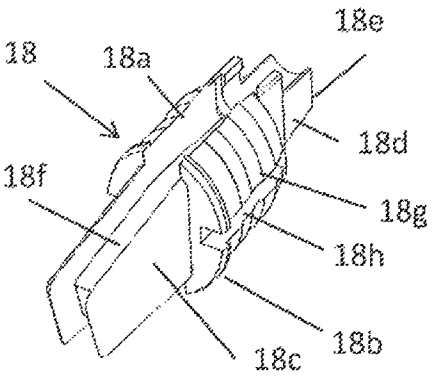

More detailedly, as shown in FIGS. 4*a* and 4*c*, the cosmetic feeder 16 has four facets of flat portions 16*b*. Since the four facets of flat portions 16*b* meet together at the corner 16*a*, the portion from carved portion 16*c* to flat portion 16*b* of the cosmetic feeder 16 can provide three different widths for drawing, a broad width W1 that is the original thickness of the cosmetic feeder 16, a medium width W2 that is defined between two flat portions 16*b* and a narrow width W3, as shown in FIG. 4*a* and FIG. 4*c*. It is preferable that the width W1 is 1 to 3 mm and the width W3 is 0.5 to 1.5 mm so that the width ratio of W1:W3=2:1.

In the above way, thanks to formation of the four flat portions, the cosmetic feeder 16 may have flat portions 16*b*, corner 16*a* and curved portion 16*c*, thus making the pen core become gradually narrower from the thick portion of the cosmetic feeder 16 toward the corner 16*a* along the ridges (contours) of flat portions 16*b*.

A specific cosmetic feeder 16 may be 1.65 mm in thickness and formed with flat portions 16*b* preferably having a length L of 2 to 3 mm and a height H of 2 to 3 mm (see FIG. 4*b*).

Referring now to the part diagram in FIGS. 5*a*-5*h*, the supporting member 18 according to the first embodiment will be described in detail.

The supporting member 18 has the cosmetic feeder 16 fixed the re around as shown in FIG. 1*b*, and is fixed to the front end opening of the front barrel 20 of the barrel cylinder 10.

As shown in FIGS. 5*a* to 5*h*, the supporting member 18 includes a roughly bulging main part 18*a*, annular flange 18*b* that is enlarged in diameter on the front side of the main part 18*a*, and a visible part 18*c* that has a roughly plate-like structure extending forwards from the flange 18*b* and is transparent to make the direction of drawing visible. The supporting member 18 further has a rear retainer 18*e* having holding pieces 18*d* that are connected to the main part 18*a* and extended rearwards on the rear side of, and from, the main part 18*e*. Moreover, formed around the whole longitudinal contour of the supporting member 18 thus formed of the above parts is a holding groove 18*f* that retains the U-shaped cosmetic feeder 16 fitted therein.

A depressed or projected fitting portion 18*g* that is extended in the width direction on each outer surface of the main body 18*a* is formed so as to be fitted into the inner periphery of the front barrel 20. Air communication channels 18*h* and 18*j* having a depressed cross section are formed on the outer peripheral side, extending from the flange 18*b* to holding piece 18*d* to exchange air. That is, air communication between the interior of the barrel cylinder 10 and the external air is performed through the air communication channels 18*h* and 18*j*. This structure makes it possible to replace the cosmetic liquid stored in the cosmetic absorbent 12 with air when the cosmetic liquid is applied through application part 14.

The supporting member 18 according to the embodiment is formed of transparent resin, glass or the like that makes the direction of application visible. Specifically, the supporting member formed of transparent resin, glass or the like has a parallel ray transmittance of 30% or higher, preferably a parallel ray transmittance of 50% or higher, and, more preferably a parallel ray transmittance of 70% or higher, and is comprised of a visible part 18*c* forming a vide smooth surface in the front and a main part 18*a* in the rear. It is unpreferable if the supporting member is formed of resin or glass having a parallel ray transmittance less than 30% because a clear view in the direction of application cannot be secured. Examples of resins and others that meet this physical property include styrene-isoprene resin, ionomer resin, SBR-PPlend resin, acrylic resin, nylon resin, polymethylpentene, PC (polycarbonate) and transparent ABS resin.

The cosmetic feeder 16 may be formed of porous material such as sponge and other polymer foams, porous rubber to be used for penetration-type stamps etc., unwoven fabric, felt, resin-solid of fiber bundles, and sintered bodies of metal, ceramics, high polymers and the like. These porous materials (this is the same in the following embodiments) may be made to cover the outer periphery of supporting member 18 by fitting bonding with adhesives, welding or other methods. In order to further enhance covering of the cosmetic feeder 16 on the outer peripheral surface of supporting member 18, fitting grooves and the like may be formed.

The application part 14 is constructed such that the cosmetic feeder 16 in the front part is formed with the same material as a whole and is overall extended around the supporting member 18 integrally and is covered and fixed by the front barrel 20 by the above-described method while the rear part is inserted into the front end of the cosmetic absorbent 12 so that the cosmetic liquid can be supplied therefrom to cosmetic feeder 16.

As shown in FIG. 1*b*, the front end of application part 14 (the front end of cosmetic feeder 16) is preferably inclined at angle of 40 to 90° with respect to the longitudinal direction LD of the barrel cylinder 10 (main body axis). In the present embodiment, the inclination is set at 75°. The shape of the application part is designated appropriately in accordance with the utility of application and other factors.

The application part 14 is constructed aiming at drawing bread drawing lines, preferably having a drawing width of 1 mm or broader, more preferably 3 mm or broader.

The cosmetic feeder 16 is formed so that the front part of the supporting member 18 is exposed from the front barrel 20.

Further, if the visible part 15*c* is formed with a lens having lens effect in the supporting member 18 (this is the same in the following embodiments), it is possible to magnify the view therethrough.

In the makeup tool having the application part 14 of the first embodiment, it goes without saying that the application part 14 can be favorably used for the thick drawing of a fine-tip and broad-tip makeup tool.

According to the makeup tool having the application part 14 of the first embodiment, when the makeup tool having the application part 14 for broad drawing lines is used to draw lines from left to right by the right hand, thanks to provision of the visible part 18*c* of transparent resin, glass or the like in the supporting member 18 the right side of the application tip is easy to view through the visible part 18*c* that is located above the application target and extending along with the longitudinal direction LD of barrel cylinder 10, thus facilitating identification of the position of the application target.

This feature makes it possible to provide markedly improved usability when the target surface is filled by the makeup tool and when the makeup tool is used in a relatively narrow space.

(Makeup Tool of the Second Embodiment)

Next the makeup tool according to the second embodiment will be described.

Figure 6A:
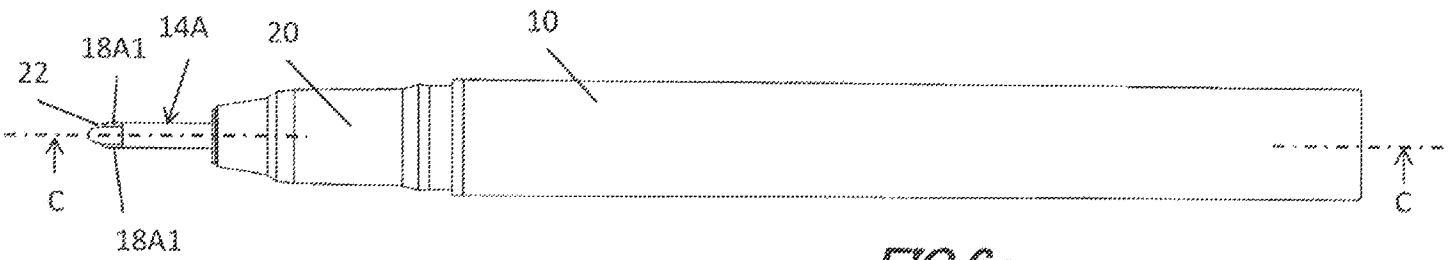
FIGS. 6*a* to 6*c* are illustrative diagrams of a makeup tool according to a second embodiment of the present invention, FIG. 6*a* showing a front view, FIG. 6*b* a front view, rotated 90° from FIG. 6*a,* and FIG. 6*c* a vertical cross section cut along a plane C-C in FIG. 6*a;*
Figure 6B:
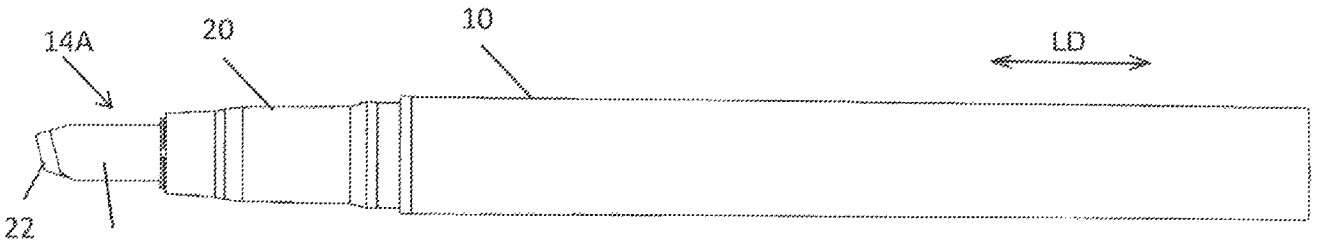
Figure 6C:
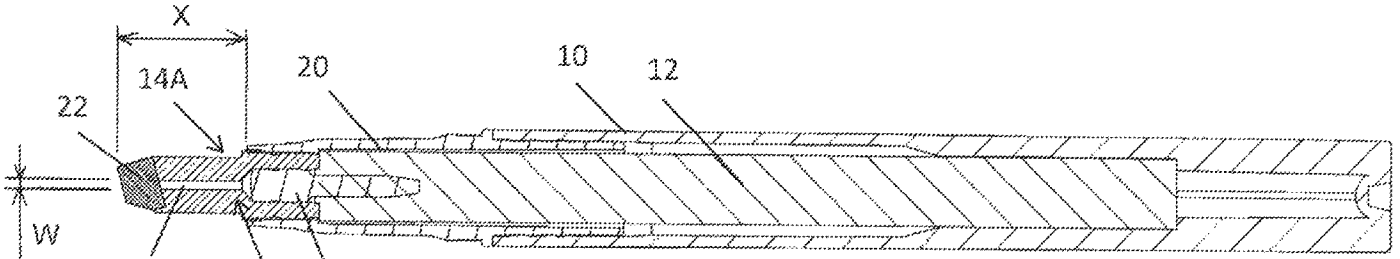

FIGS. 6*a*-6*c* show illustrative diagrams of a makeup tool according to the second embodiment of the present invention, FIG. 6*a* the front view, FIG. 6*b* the front view rotated 90° and FIG. 6*c* a cross section cut along a plane C-C in FIG. 6*a*.

This makeup tool of the present embodiment is a pen type, having a barrel cylinder 10 to be the makeup tool main body, a cosmetic absorbent 12, a porous joint 30 and an application part 14A.

The barrel cylinder 10 is formed of thermoplastic resin, thermosetting resin, glass and/or the like, accommodates the cosmetic absorbent 12 impregnated with a makeup cosmetic and has a front barrel 20 at the front end for fixing the application part 14A. The barrel cylinder 10 and front barrel 20 are configured in the same manner in the first embodiment, in the other aspects.

The cosmetic absorbent 12 is impregnated with fluid cosmetics such as water-based cosmetics, and may use the same material as that of the cosmetic absorbent 12 of the first embodiment. This cosmetic absorbent 12 is accommodated inside the main body of the barrel cylinder 10. Here, the barrel cylinder 10 is closed at its rear end, however, may be sealed by a tail plug formed of the same material as the barrel cylinder 10 or another synthetic resin material, etc.

The porous joint 30 is a relay core that supplies the cosmetic from the cosmetic absorbent 12 to a cosmetic feeder 16A disposed on a supporting member 18A (corresponding to "retainer"), and is formed of a continuous porous material (channels) such as, similarly to the cosmetic absorbent 12, a fiber bundle, a fiber bundle core formed of fiber bundles inclusive of felt etc., hard sponge, resin particle porous body formed of resin particle sintered body or the like, sliver core and the like. The shape, structure and other configurations of the porous joint 30 are not particularly limited as long as the porous joint 30 can supply the impregnated cosmetic in cosmetic absorbent 12 to cosmetic feeder 16A of the supporting member 18A. This porous joint 30 may have a cross section of a circle, ellipse, square, rectangle, trapezoid, parallelogram, rhomboid, hog-backed shape, semi-circle, or the like. In the present embodiment, the porous joint has a circular cross section. Here, the porous joint 30 of the present embodiment is structured to be held by the supporting member 18A that is fitted into front barrel 20, as shown in FIG. 6*c*.

The application part 14A includes a porous application piece 22 to be the applying element and the supporting member 18A that holds the porous application piece 22 and has the cosmetic feeder 18A for feeding the cosmetic to the application part.

The porous application piece 22 forming the applying element of the present embodiment is fixed to the front end of the supporting member 18A, and may be a parallel fiber bundle, a fabric core of a shaped fiber bundle such as felt etc., or a resin-shaped fiber bundle core of these fiber bundles, the fiber being formed of one kind of fiber, or two or more kinds of fibers, selected from, for example, natural fiber, animal hair fiber, polyacetal resin, polyethylene resin, acrylic resin, polyester resin, polyamide resin, polyurethane resin, polyolefin resin, polyvinyl resin, polycarbonate resin, polyether resin, polyphenylene resin and the like, or may be a porous body (sintered core) formed by sintering appropriate plastic powders.

The external shape of the porous application piece 22 to be the application part may be, for example, chisel shape, bullet shape, cylindrical shape, elliptic cylindrical shape, cubic shape, cuboid shape, or the like. The cross section of the porous application piece may have, for example, a trapezoidal shape, parallelogram, shape, rhomboidal shape, semi-cylindrical shape, semi circler shape, or the like. In this embodiment, the porous application piece 22 is formed in the chisel shape. The chisel shape herein means that the application tip has a flat facet inclined with respect to the axis of the pen.

The porous application piece 22 forming the application element is preferably formed to have a tip facet inclined 40 to 90° with respect to the longitudinal direction LD (FIG. 6*b*) of the barrel cylinder 10 (main barrel) so as to facilitate makeup application. In this embodiment, this inclination is set at 75°.

The shape, inclination and other configurations of the porous application piece 22 forming the applying element are appropriately designated according to the intended purpose such as an application and the like. Further, the porous application piece 22 forming the applying element is configured to draw broad drawing lines, preferably having a drawing width of 2 mm or broader, more preferably 3 mm or broader.

The supporting member 18A of the present embodiment is formed of a material providing visibility, examples including PP, PE, PET, PEN, nylons (including general nylons such as 6 nylon and 12 nylon and further including non-crystalline nylons), acryl, polymethyl pentene, polystyrene, ABS and the like. It is preferable that the material of the supporting member is formed to have a visible light transmittance of 50% or higher.

Use of a material having a visible light transmittance of less than 50% is unpreferable because the applied object located in the direction of application cannot be clearly seen. In order to provide further improved visibility, use of a material having a visible light transmittance of 50% or higher is preferable. It is more preferable to provide further fine visibility if the visible light transmittance is 80% or higher.

The visible light transmittance can be determined by measuring the reflectance using a multi light source colormeter.

This supporting member 18A can be configured using one of the above-described materials or two or more kinds of materials for further improved endurance and visibility. When two or more kinds of materials are used, it is preferable that, at least, one of them is a material having a visible light transmittance of 50% or higher. A various kinds of molding methods such as injection molding and others can be used to form the supporting member.

The supporting member 18A has, at least, one communication channel of cosmetic feeder 16A for feeding the cosmetic to the application part, therein. In the present embodiment, in view of maximizing the area ratio of the visible part and in view of efficiently supplying the cosmetic to the porous application piece 22 to be the applying element, one cosmetic feeder 16A extending along pith the longitudinal direction LD is formed into a through-hole penetrating the center of the application part 14A, as shown in FIG. 6*c*.

As long as the configuration of this cosmetic feeder 16A take a structure that can directly feed the cosmetic being soaked up in the cosmetic absorbent 12 in the main makeup tool body, to the cosmetic feeder via the above-described porous joint 30, the shape, structure, size and the number of the cosmetic feeders 16A can be designed appropriately.

In view of maximizing the effect of the present invention, the width W (FIG. 6*c*) of the cosmetic feeder 16A in the section is preferably less than 40% of the length X (FIG. 6*c*) of the longitudinal direction of the applying element, more preferably less than 1 to 30%. The cross section of the cosmetic feeder 16A is preferably less than the transverse cross section of the narrow width side (FIG. 6A) of the retainer 18A of the application part 14A or less than the transverse cross section of the porous joint 30.

In particular, in view of securing a sufficient amount of application liquid without losing the visibility through the retainer, the width W an the transverse cross section of the cosmetic feeder 16A is equal to 3 mm or smaller, preferably 0.1 to 2.5 mm. Further, the cosmetic feeder 16A is preferably a tubular channel having a diameter of 0.1 to 3.0 mm, preferably 0.2 to 2.5 mm, more preferably 0.2 to 2.0 mm.

The total transverse cross section of the cosmetic feeder 16A inside the supporting member 18A is 0.01 to 7 $mm^2$, preferably 0.03 to 5 $mm^2$, or more preferably 0.03 to 4 $mm^2$.

Further, the cosmetic feeder 16A is preferably tapered toward the porous application piece 22 side of the applying element. Two or more cosmetic feeders that are extended at an angle 0 to 30° relative to the direction LD of the longitudinal axis of the barrel cylinder 10 (main body axis) may be formed, but a single cosmetic feeder alone is preferable.

The cosmetic feeder 16A is preferably formed straight in the direction LD of the longitudinal axis, but may be formed in a V-shape, X-shape, Y-shape, spiral shape, inverted V-shape or inverted Y-shape so as to be easily recognized visually.

Examples of the method for forming the cosmetic feeder 16A having the above configuration, include a method whereby the cosmetic feeder 16A is created in the supporting member 18A by feeding resin into a metal die having a rod or the like for molding the cosmetic feeder by use of an appropriate molding method such as injection molding and then separating the die; a method whereby the cosmetic feeder 16A is created in the supporting member 18A by molding the supporting member 18A and then forming a bore by drilling, laser shaping or the like; and a method whereby the cosmetic feeder 16A is created in the supporting member 18A by forming the supporting member 18A of two pieces each formed with a groove for forming the cosmetic feeder 16A, then joining the pieces by bonding, welding or the like. That is the same methods as those described in the prior art documents can be used.

It is preferable that the cosmetic feeder 16A thus formed inside the supporting member 18A has a visible light transmittance of less than 50% when the aftermentioned cosmetic is fed so that the feeder will not function as the visible part, and the user cannot view the direction of application effectively. In some cases, if the other side of the cosmetic feeder 16A can be seen therethrough when the cosmetic feeder 16A is filled with the cosmetic, use of the coloring components and the like in the cosmetic is limited so that the makeup colors meeting needs cannot be obtained, which is unpreferable. In such a case, a pipe colored with substantially the same color as that of the makeup cosmetic may be inserted into the cosmetic feeder 16A so that the user can easily recognize the makeup color.

The part other than the cosmetic feeder 16A in the supporting member 18A forms surfaces for the visible part. In order to effectively make the direction of application visible, the surfaces for the visible parts preferably are arranged approximately parallel. Here, the visible part is formed with a lens so as to allow the user to view magnified images.

In the present invention, adhesion between the porous application piece 22 as the applying part and the supporting member 18A having the cosmetic feeder 16A has to be carried out by robustly bonding the porous application piece 22 with the interface being tightly sealed. In view of this, the porous application piece 22 is preferably fixed to the supporting member 18A by provision of a retainer resin layer, which is formed by making the resin of the supporting member 18A enter the fine pores on the bumpy contact surface of the porous application piece 22.

It is preferable that the porous application piece 22 and supporting member 18A are formed of different resins having different solubilities to the solvent. For example, when the porous application piece 22 is a polyethylene sintered core while the retainer is formed of acryl, use of organic solvents such as alcohols, esters (butyl acetate), ethers, ketones (acetone), glycol ethers, alicyclic hydrocarbons, aliphatic hydrocarbons, chlorinated aliphatic hydrocarbons (dichloromethane), aromatic hydrocarbons and chlorinated aromatic hydrocarbons, makes it possible to assure the difference in solubility parameter (SP value) between the porous body resin and the retainer resin to be equal to or greater than 0.5, hence enabling fixture between the porous application piece 22 to be the applying element and the supporting member 18A having the cosmetic feeder 16A.

At the cosmetic feeder 16A's endface on the porous application piece 22 side, the retainer resin layer (the interface of the retainer resin layer is also referred to as "bonding surface") is formed in the interface between the porous application piece 22 and supporting member 18A, and the bonding surface is formed, preferably 0.5 mm or greater, or more preferably 0.8 to 3 mm, in all directions from the endface.

The bonding surface may be given in any of a flat surface, curved surface and bent portion. The bonding surface on the porous application piece 22 opposite to the endface of the cosmetic feeder 16A is formed preferably 0.5 mm or greater, or more preferably 0.8 to 3 mm, along the whole periphery of the endface.

The retainer resin layer on the bonding surface is formed preferably 1 to 1000 μm, or more preferably 10 to 800 μm, into the interior of the porous application piece 22. The surface of local projections inn the contact area on the supporting member 18A in contact with porous application piece 22 is preferably formed to be stain-finished by an embossing process or other method.

In this application part 14A, in order to firmly fix the porous application piece 22 as the applying element to the supporting member 18A having the cosmetic feeder 16A, two or more rib pieces 18A1 (see FIG. 6*a*) are formed in distal end of the supporting member 18A so as to along two or more sides of the porous application piece 22. In the present embodiment, two rib pieces are provided.

The bonding interface between the porous application piece 22 and the supporting member 18A having the cosmetic feeder 16A is comprised of two side flat interior surfaces of the rib pieces 18A1 and the flat bottom surface of the supporting member 18A other than the opening of cosmetic feeder 16A. Further, in the supporting member 18A, the local projections in the contact area with the porous application piece 22 are formed stain-finished by the embossing process or the like. It is also possible to form the application part 14A by use of a two-color molding process so as to fix the porous application piece 22 to the supporting member 18A.

In this embodiment thus constructed, the porous application piece 22 to be the applying element and the supporting member 18A having the cosmetic feeder 16A are bonded in the contact area between the porous application piece 22 and the supporting member 18A by penetration of the resin that forms the retainer in the supporting member 18A, into the bumpy surface formed of fine pores of the porous application piece 22 so as to form the retainer resin layer in the bottom face. Accordingly, the porous application piece 22 to be the applying element and the supporting member 18A having the cosmetic feeder 16A can be reliably bonded so that it is possible to provide a makeup tool that is excel lent in endurance, assuring a sufficient flow amount of application liquid until the last drop of the cosmetic.

In the present embodiment, the porous joint 30 and the supporting member 18A can also be bonded in the same manner as above, i.e., by forming a retainer resin layer.

Specifically, the bonding interface on the porous joint 30 side is formed with any one of a flat surface, curved surface or bent portion while in the cosmetic feeder 16A's endface opposite to the porous joint 30 the porous joint 30 is inserted into the hollow opening in the rear part of the supporting member 18A and a retainer resin layer (also referred to as "bonding interface on the porous joint") as the interface is formed of 0.5 mm or greater thick over the whole circumference of the porous joint 30. The retainer resin layer circularly covering the bonding surface on the porous joint 30 side penetrates 1 to 1000 μm into the porous body while the surface of local projections in the contact area of the rear portion of the supporting member 18A in contact with porous joint 30 is formed stain-finished by an embossing process or other method.

In this embodiment thus constructed, the porous joint 30 and the supporting member 18A having the cosmetic feeder 16A are bonded by penetration of the resin that forms the retainer in the supporting member 18A, into the bumpy surface formed of fine pores in the area of porous joint 30 where the porous joint 30 comes into contact with the support member 18A so as to form the retainer resin layer. Accordingly, the porous joint 30 and the supporting member 18A having cosmetic feeder 16A can be reliably fixed so that it is possible to assure a sufficient flow of application liquid to the cosmetic feeder 16A and provide a makeup tool that is excellent in endurance. Further, the retainer resin layer may be formed in the whole area where the supporting member 18A and the porous joint 30 are brought in contact by squeezing the porous joint 30.

In the makeup tool of the present embodiment, as described above, the application part 14A is composed of the porous application piece 22 serving the applying element and the supporting member 18A that supports the porous application piece 22 and has at least one cosmetic feeder 16A for supplying the cosmetic to the application part 14A, and further includes the porous joint 30 for supplying the cosmetic stored in the barrel cylinder 10 of the makeup tool to the cosmetic feeder 16A provided in the supporting member 18A, and the supporting member 18A is formed of a material providing visibility. Accordingly, the whole surface (entire) of supporting member 18A other than the cosmetic feeder 16A serves as a visible part through which the object in the direction of application can be seen. This arrangement finally makes it possible to secure the area ratio of the visible part in the application part 14A that is projected from the front end of the main body of the barrel cylinder 10, to be equal to or higher than 40%. Further, when the visible part on the supporting member 18A's side face of the application part 14A is also formed to be equal to or higher than 40% while the cosmetic feeder 16A is longitudinally formed in the center of the supporting member 18A and the width, diameter, cross section and the like of the cosmetic feeder 16A are specified to fall within the above-described preferable ranges, it is possible to further improve the area ratio of the visible part to 50% or higher, thus making it possible to provide a makeup tool that can be used until the end of application. In particular, by forming the cosmetic feeder 16A along with the longitudinal direction of the support member in the center of the supporting member 18A, it is possible to supply the cosmetic uniformly and efficiently to the porous application piece 22 to be the applying element, and it is hence possible to provide a further improved makeup tool, that can be used until the last drop of the cosmetic liquid.

By forming the cosmetic feeder 16A along with the longitudinal direction of the support member in the center of the supporting member 18A, it is possible to facilitate determination of the direction of application and provide a markedly easy-to-apply configuration.

Further, the structure that allows the liquid to be directly fed to the cosmetic feeder 16A makes it possible to efficiently supply the cosmetic liquid to the porous application piece 22 serving as the applying element. It should be noted that when a porous material is used for the cosmetic feeder 16A, there are some cases where a favorable flow of cosmetic liquid cannot be obtained.

The makeup tool of the present invention should not be limited to the above. Various modifications can be made without departing from the scope of the present invention. The shape of the cosmetic feeder 16A may be given in a letter shape or other forms such as a V-shape, X-shape, Y-shape, spiral form, inverted V-shape, inverted X-shape and the like.

(Makeup Tool of the Third Embodiment)

Next, the makeup tool according to the third embodiment of the present invention will be described.

Figure 7A:
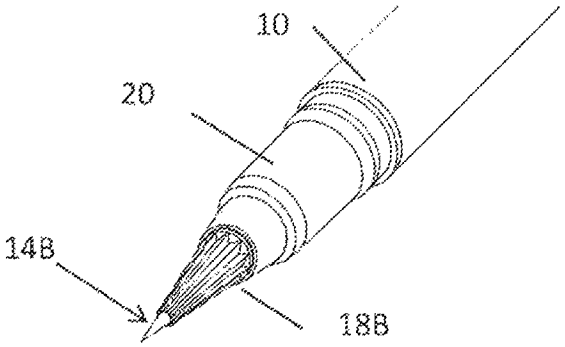
FIGS. 7*a* to 7*c* are illustrative diagrams of a makeup tool according to a third embodiment of the present invention, FIG. 7*a* shoving a perspective view from the front, FIG. 7*b* a front view, and FIG. 7*c* a vertical cross section cut along a plane C-C in FIG. 7*b;*
Figure 7B:
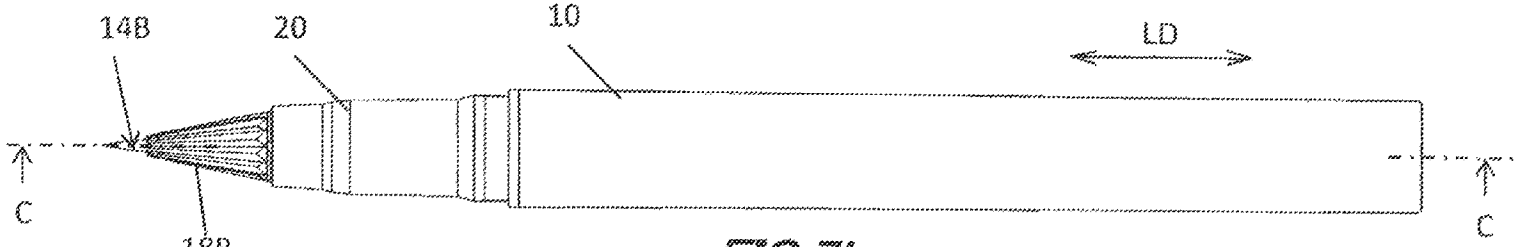
Figure 7C:
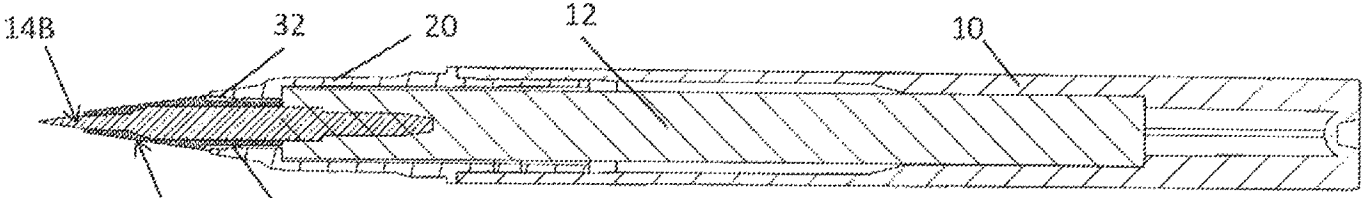

FIGS. 7*a*-7*c* show a makeup tool according to the third embodiment of the present invention, FIG. 7*a* a perspective view, FIG. 7*b* a front view, and FIG. 7*c* a sectional view, FIGS. 8*a*-8*h* are a part diagram showing a supporting member (corresponding to "retainer") 18B of this makeup tool.

As shown in FIG. 7C, a barrel cylinder 10 that forms the external part of the makeup tool is closed at its rear end. A cosmetic absorbent 12 impregnated with a fluid is accommodated in the interior space of the barrel cylinder 10. A front barrel 20 is attached at the front end of the barrel cylinder 10. The front barrel 20 is a cylinder having an interior space that is tapered stepwise toward the front. A brush-like application part 14B is arranged inside the front part of the front barrel 20 so as to stick out from the front end of the supporting member 18B. The rear end of the application part 14B is inserted into and joined to the cosmetic absorbent 12 and made to penetrate through the axial center of the supporting member 18B.

The application part 14B can employ polybutylene terephthalate fibers bundled to form a pointed tip when the application part 14B is of a brush type, whereas nylon, polyester and acryl can be used as the application part 14B when the application part 14B is of a pen core type.

As shown in FIG. 7, the supporting member 18B is fitted into the barrel cylinder 10 on the front side of the interior space in which cosmetic absorbent 12 is accommodated.

FIGS. 8*a*-8*h* are an illustrative diagram of the supporting member 18B.

The supporting member 18B is formed of a transparent or translucent body. The supporting member 18B of the present embodiment is formed of a material providing visibility, such as styrene-isoprene resin, ionomer resin, SSR-PPblend resin, acrylic resin, nylon resin, polymethyl pentene, PC (polycarbonate), transparent ABS resin and the like, preferably having a visible light transmittance of 50% or higher.

Use of a material having a visible light transmittance of less than 50% is unpreferable because the applied object located in the direction of application cannot be clearly viewed. In order to provide further improved visibility, use of a material having a visible light transmittance of 50% or higher is preferable. A further improved visibility can be obtained if the visible light transmittance is 80% or higher.

Figure 8G:
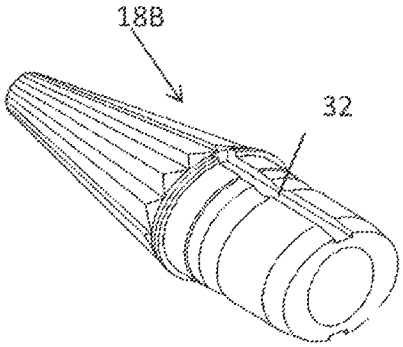
FIGS. 8*a* to 8*h* are part diagrams of a supporting member (retainer) in the makeup tool of FIGS. 7*a* to 7*c,* FIG. 8*a* showing a perspective view from the front, FIG. 8*b* a view from the front, FIG. 8*c* a front view, FIG. 8*d* a vertical cross section cut along a plane D-D in FIG. 8*b,* FIG. 8*e* a front view rotated 90° from FIG. 8*c*, FIG. 8*f* a vertical cross section cut along a plane F-F in FIG. 8*b*.
Figure 8C:
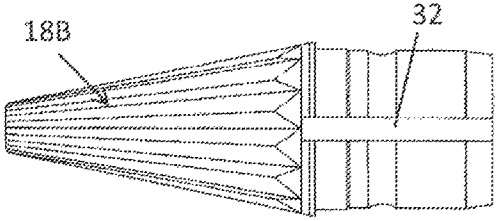
Figure 8D:
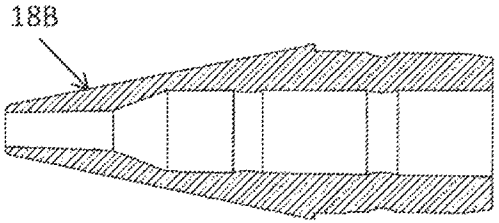
Figure 8A:
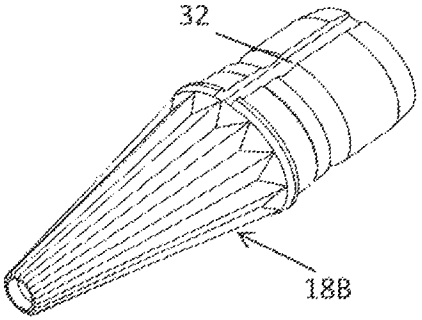
Figure 8H:
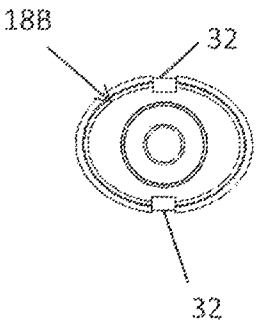
Figure 8E:
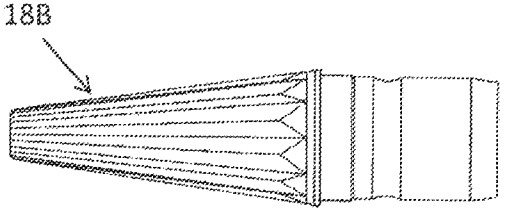
Figure 8F:
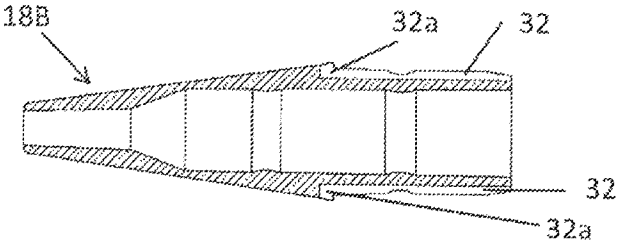
Figure 8B:
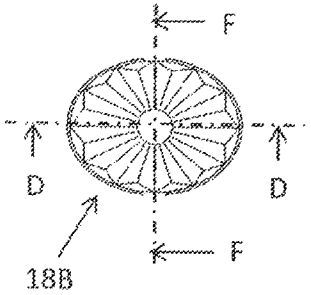

As shown in FIG. 8*f*, a pair of grooves 12 are arranged on the left and right sides in the rear part of the supporting member 18B. As the rear half of this supporting member 18B is press fitted into the front end of the front barrel 20, the groove 32 will create an air exchange hole in cooperation with the interior wall in the front part of the front barrel 20 (see FIG. 7). Accordingly, the air exchange hole is opened on each of left and right sides of the makeup tool.

The supporting member 18B has a tapered front part having an outer surface corrugated in the circumferential direction, namely formed with ridges and furrows extended in the front-to-rear direction, forming a star-shaped or flower-shaped transverse cross-section. This is, of course, a mere example, hence various configurations can be adopted. Since the supporting member 18B is transparent, the color of the application part 14B can be easily understood. Further, the outer peripheral side of the supporting member 18B is corrugated, the application part 14B is magnified thanks to lens effect, which may match the supporting member 18B to produce an improved appearance design.

The makeup tool according to this embodiment functions as follows.

The fluid soaked up in the cosmetic absorbent 12 (FIG. 7*c*) is drawn toward the front end by capillary action of the application part 14B to reach and immerse the tip of the application part 14B, thereby enabling application of liquid to a target place. Air flowing through the air exchange holes of the grooves 32 reaches the interior space of the barrel cylinder 10 in which cosmetic absorbent 12 is accommodated. In this way, air exchange with the fluid can be smoothly performed.

Suppose that an impact toward the tip of the applicator abruptly acts on the applicator, most of the fluid is blocked by the interior stepped portion of the barrel cylinder 10, but part of the fluid will pass through air exchange holes (grooves 32). However, since each air exchange hole has a 90-degree bend portion (32*a*: see FIG. 8*f*), the fluid has to go round 90° left and right, no fluid will directly leak out to the outside. The fluid temporarily held at the front end side In the air exchange holes will be pushed back toward the cosmetic absorbent 12 in a while by the outside air that flows in through the air exchange holes.

[Explanation of Cosmetics]

Next, the cosmetics used for the makeup tools according to the first to third embodiments will be described.

The cosmetic liquid of the present invention contains 0.5 to 5 mass % dispersant that at least consists of carbon black, water and film forming resin, 2 to 15 mass % film forming agent (in terms of solid content), and 0.5 weight % or lower surfactant, and is characterized in that the viscosity measured at a temperature of 25° C. at a shear rate of 3.83 (l/s) by an ELD type viscometer falls within a range of 2 to 8 mPa·s.

The carbon black used in the present invention is that used as coloring material, and is not particularly limited. Any kind of carbon black can be used as long as it is a carbon black that is usually used as a coloring material for black liquid cosmetics.

The content of the carbon black is preferably 1 to 20 mass % or more preferably 5 to 15 mass % of the total amount of the liquid cosmetic. If the content of carbon black is less than 1 mass %, the color of the resultant solution is too thin to be used for cosmetics. On the other hand, if the content exceeds 20 mass %, the viscosity of the resultant solution becomes too high, so that the liquid cannot be delivered smoothly when a liquid cosmetic makeup tool of a sliver type of the present invention or of a collector type or the like is used, producing unpreferable result.

The dispersant used in the present invention is formed of film forming resin, hence also function as a resin for film forming in addition to improving the dispersibility of carbon black as a coloring material.

Examples of usable dispersants include, copolymers of one or two or more kinds of compounds, selected from acrylic acid, methacrylic acid, alkyl esters or derivatives of these, vinyl, acetate and vinylpyrrolidone; and betaine-type alkyl acid amphoteric resin. In view of improving dispersibility of carbon black, copolymers of one compound selected from acrylic acid, methacrylic acid, alkyl esters or derivatives of these with vinyl acetate; vinylpyrrolidone/vinyl acetate copolymer; or copolymers of one or more compounds selected from acrylic acid, methacrylic acid and alkyl esters of these with octylacrylamide, are preferable. In view of further improved dispersibility and film forming performance, copolymers of one or more compounds selected from acrylic acid, methacrylic acid, and alkyl esters of these with octylacrylamide is particularly preferable.

The content of the dispersant is preferably 0.5 to 5 mass % of the total amount of the liquid cosmetic, more preferably 2 to 4 mass %.

If the content of the dispersant is less than 0.5 mass %, the dispersion stability of carbon black as the coloring material becomes insufficient. On the other hand, the content of the dispersant exceeding 5 mass % makes the viscosity too high so that no improvement in dispersion stability is obtained, hence will not bring about any economic advantages.

Examples of the film forming agent used for the present invention include emulsion resin of copolymers of one or two or more kinds of monomers selected from acrylic acid; methacrylic acid; alkyl esters and derivatives of these; styrene and vinyl acetate.

In the present invention, the dispersant is also formed of film forming resin, the difference from the above-mentioned dispersant is that the former is soluble resin whereas the latter is emulsion resin. The emulsion resin is an aqueous suspension that is obtained by emulsion polymerizing monomers in water as the polymerization solvent. In dispersing carbon black in the present invention, use of soluble resin can produce more stable carbon black dispersion than use of emulsion resin. This is why these agents are used separately.

The content of the film forming agent (emulsion resin) is preferably 2 to 15 mass more preferably 2 to 10 mass % relative to the total amount of liquid cosmetic in terms of solid content (resin content).

If the content of the film forming agent (emulsion resin) is less than 2 mass % in terms of solid content (resin content), sufficient water-repellent performance cannot re obtained. On the other hand, the content of the film forming agent exceeding 15 mass % in terms of solid content (resin content) may make the application part (brush, pen core of the like) of the liquid cosmetic makeup tool dry, causing an application failure, which is unpreferable.

In order to stabilize these film forming agents (emulsion resin), some surfactants maybe added. However, the surfactants blended herein will little affect the stickiness of the present invention, so no consideration will be given as to their content.

The surfactants used in the present invention function to assist dispersion of carbon black. Examples are nonionic surfactants, anionic surfactants and cationic surfactants. Specifically, lecithin, propylene glycol fatty acid ester, glycerin fatty acid ester, polyglycerin fatty acid ester, mixtures of one or two or more kinds of compounds selected from polyoxyethylene alkylether, polyoxyethylene polyoxypropylene alkylether, polyoxyethylene alkylether phosphoric acid and phosphate, polyethylene glycol fatty acid ester, alkyl sulfate, sulfonate, polyoxyethylene alkyl ether sulfate and the like, may be listed.

The content of these surfactants is preferably equal to lower than 0.5 mass %, more preferably 0 to 0.3 mass % relative to the total amount of the liquid cosmetic.

If the content of the surfactant exceeds 0.5 mass %, water-repellent performance degrades, and sufficient stickiness cannot be obtained, which is unpreferable.

The liquid cosmetic of the present invention uses water (including purified water, distilled water, ion exchanged water, pure water, super pure water and the like) as the solvent. The content of water is the balance after the contents of the above-described components and the aftermentioned optical components are subtracted.

Further, the liquid cosmetic of the present invention may contain optional components that are used for ordinary liquid cosmetics, in addition to the above-described essential components. Specifically, preservatives, antioxidants, counteractives, ultraviolet absorbers, chelating agents, humectants, beauty ingredients, aromatics, viscosity modifiers and the like can be added as appropriate within the ranges that will not degrade the effect of the present invention.

The liquid cosmetic of the present invention is specified so that the viscosity measured at a temperature of 25° C. at a shear rate of 3.83 (l/s) by an ELD type viscometer falls within a range of 2 to 8 mPa·s, more preferably within a range of 3 to 6 mPa·s.

If this viscosity is less than 2 mPa·s, the liquid flows into wrinkles or the like, forming blurs. Because the viscosity exceeding 8 mPa·s is too high, the liquid cannot be smoothly delivered from the liquid cosmetic makeup tool of the present invention that uses a brush or pen core as the application means, which leads to unpreferable result. As to the conditions for viscosity measurement (also applied to the embodiments hereinbelow), the viscosity is measured by use of an ELD type viscometer with a standard cone rotor, a product of TOKI SANGYO CO., LTD., at 1 rpm, 25° C. and a shear rate of 3.33 (l/s).

(Makeup Tool of the Fourth Embodiment)

Next, the makeup tool according to the four embodiment of the present invention will be described.

Figure 9B:
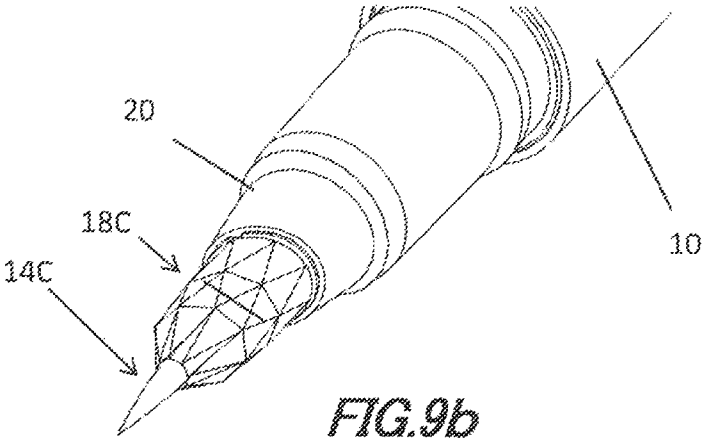
FIGS. 9*a* to 9*d* are illustrative diagrams of a makeup tool according to a fourth embodiment of the present invention, FIG. 9*a* showing a view from the front, FIG. 9*b* a perspective view from the front, FIG. 9*c* a front view, and FIG. 9*d* a vertical cross sect ion cut along a plane C-C in FIG. 9*a;*
Figure 9C:
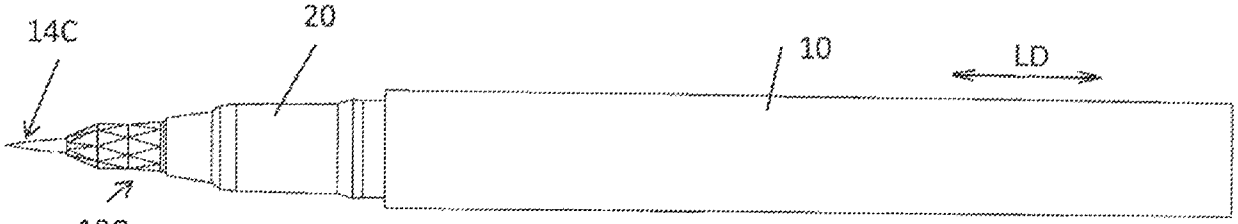
Figure 9A:
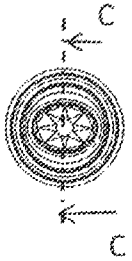
Figure 9D:
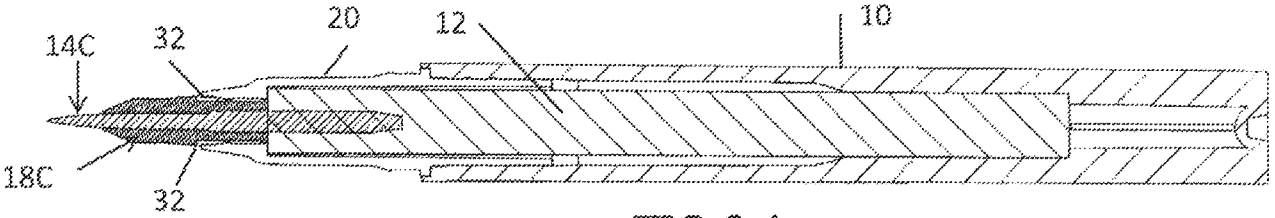

FIGS. 9*a*-9*d* show a makeup tool according to the fourth embodiment of the present invention, FIG. 9*a* a view from the front, FIG. 9*b* a perspective view, FIG. 9*c* a front view, and FIG. 9*d* a vertical cross section, FIGS. 10*a*-10*h* are a part diagram showing a supporting member (corresponding to "retainer") 18C of this makeup tool. Here, for a barrel cylinder 10, cosmetic absorbent 12 and front barrel 20, the same components as those in the third embodiment are allotted with the same reference numerals.

As shown in FIGS. 9*b*-9*d*, in this makeup tool, a brush-like application part 14C is arranged inside the front part of the front barrel 20 so as to stick out from the front end of the supporting member 18C. The rear end of the application part 14C is inserted into and joined to the cosmetic absorbent 12 and the application part 14C is made to penetrate through the axial center of the supporting member 18C.

Similar to the third embodiment, the application part 14C can employ polybutylene terephthalate fibers bundled to form a pointed tip when the makeup tool is of a brush type, whereas nylon, polyester and acryl can be used as the application part when the makeup tool is of a pen core type.

Figure 10G:
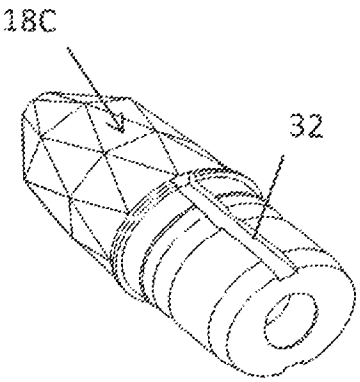
FIGS. 10*a* to 10*h* are part diagrams of a supporting member (retainer) in the makeup tool shown in FIGS. 9*a* to 9*d,* FIG. 10*a* showing a perspective view from the front, FIG. 10*b* a view from the front, FIG. 10*c* a front view, FIG. 10*d* a vertical cross section cut along a plane D-D in FIG. 10*b,* FIG. 10*e* a front view rotated 90° from FIG. 10*c*, FIG. 10*f* a vertical cross section cut along a plane F-F in FIG. 10*b*, FIG. 10*g* a perspective view from the rear, and FIG. 10*h* a view from the rear.
Figure 10C:
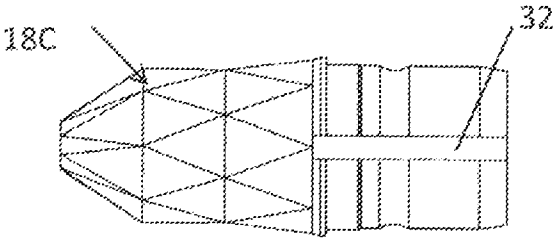
Figure 10D:
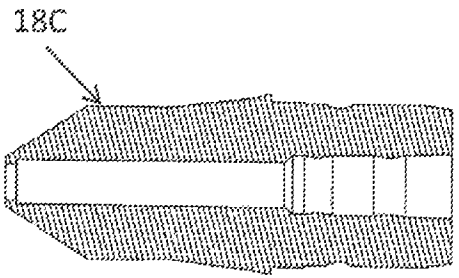
Figure 10A:
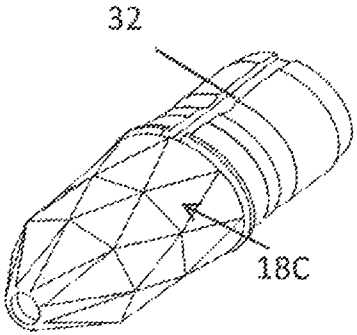
Figure 10H:
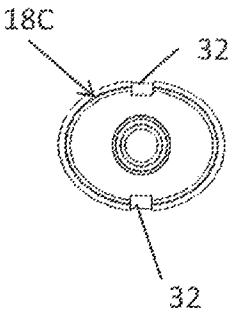
Figure 10E:
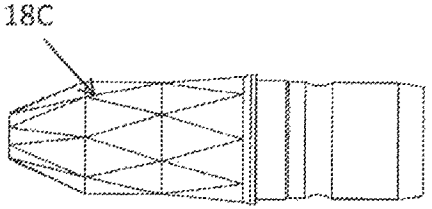
Figure 10F:
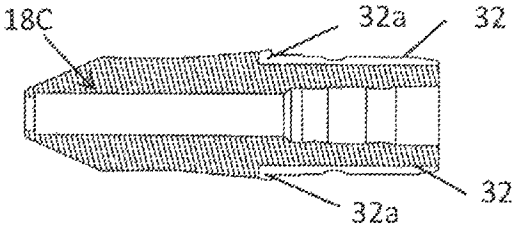
Figure 10B:
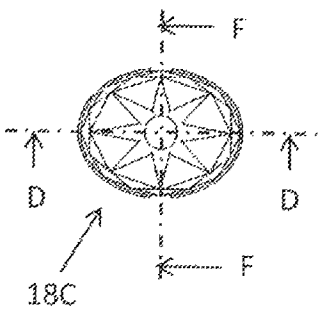

As shown in FIGS. 10*a*-10*h*, the supporting member 18C is formed of transparent resin and has an external configuration having many triangular faces. As shown in FIG. 10*a*, when viewed from the front, the supporting member has a symmetrical elliptic shape. Further, a pair of grooves 32 are formed on the left and right sides in the rear part of the supporting member 18C. As the rear half of this supporting member 18C is press fitted into the front end of the front barrel 20, the groove 32 will create an air exchange hole in cooperation with the interior wall in the front part of the front barrel 20 (see FIG. 9*d*).

As the resin forming the supporting member 18C, any of styrene-isoprene resin, ionomer resin, SBR-PPblend resin, acrylic resin, nylon resin, polymethyl pentene, PC (polycarbonate), transparent ABS resin and the like can be used as long as it is transparent. The supporting member 18C is preferably formed of a material having a visible light transmittance of 50% or higher.

Further, in order to enhance impression of surface reflection on the supporting member 18C, it is preferable that the shining facets change one to another as the angle of view changes.

In particular, when the supporting member 18C is formed with a large number of triangular facets like a diamond so that many facets successively give off reflective shines with small change of angle, it can give effective shining impression.

Further, in order to enhance surface reflection on the supporting member 18C, it is better that the edges (ridges) are clearly formed. For example, the edge is preferably formed with a radius of 0.5 mm or smaller.

It is also possible to emphasize both the surface reflection and the total internal reflection by forming the supporting member 18C of a thicker transparent part (transparent resin part) while making the pen core thinner.

When the supporting member 18C is formed of a material having a high Abbe value (producing low light dispersion), the member can give off cool light producing luxurious brilliance like a diamond. In this case, use of a material having a higher refractive index makes it easy to generate both surface reflection and total internal reflection.

(Makeup Tool of the Fifth Embodiment)

Next, the makeup tool according to the fifth embodiment of the present invention will be described.

Figure 11B:
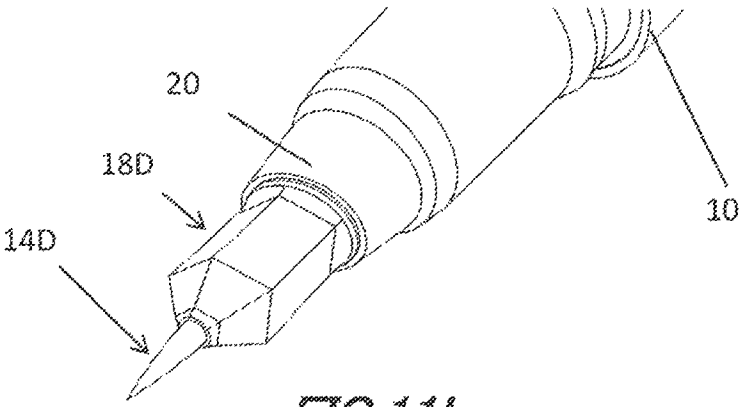
FIGS. 11*a* to 11*d* are illustrative diagrams of a makeup tool according to a fifth embodiment of the present invention, FIG. 11*a* showing a view from the front, FIG. 11*b* a perspective view from the front, FIG. 11*c* a front view, and FIG. 11*d* a vertical cross section cut along a plane D-D in FIG. 11*a;*
Figure 11C:
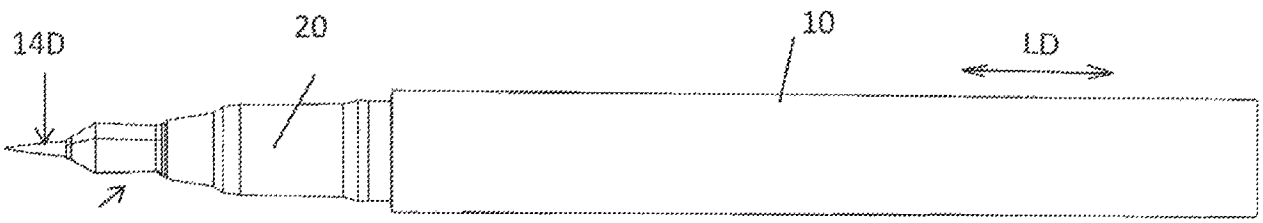
Figure 11A:
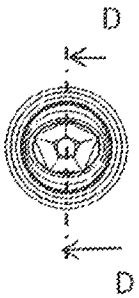
Figure 11D:
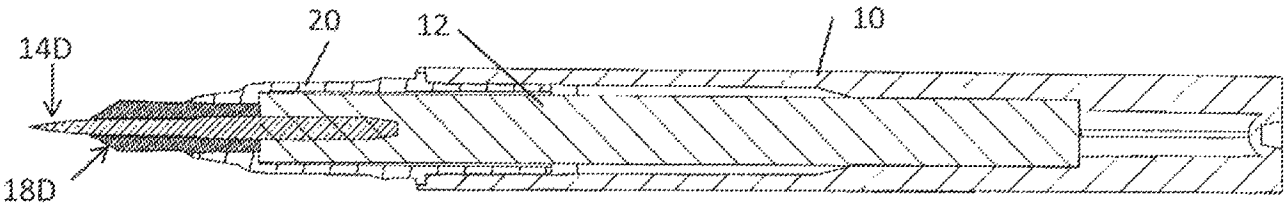

FIGS. 11*a*-11*d* show a makeup tool according to the fifth embodiment of the present invention, FIG. 11*a* a view from the front, FIG. 11*b* a perspective view, FIG. 11*c* a front view, and FIG. 11*d* a vertical cross section, FIGS. 12*a*-12*g* are a part diagram showing a supporting member (corresponding to "retainer") 18D of this makeup tool.

FIGS. 13*a*-13*e* are an illustrative diagram showing refraction states of light rays in the supporting member 18D.

Here, for a barrel cylinder 10, cosmetic absorbent 12 and front barrel 20 in FIGS. 11*a* to 12*g*, the same components as those in the fourth embodiment are allotted with the same reference numerals.

Figure 12A:
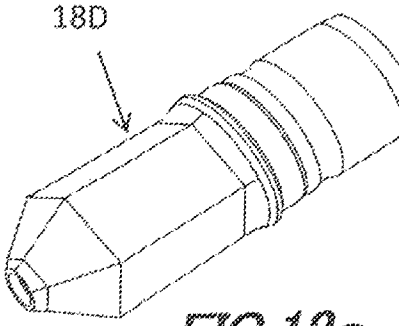
FIGS. 12*a* to 12*g* are part diagrams of a supporting member (retainer) in the makeup tool shown in FIGS. 11*a* to 11*d*, FIG. 12*a* showing a perspective view from the front, FIG. 12*b* a view from the front, FIG. 12*c* a plan view, FIG. 12*d* a front view, FIG. 12*e* a vertical cross section cut along a plane F-F in FIG. 12*b*, FIG. 12*f* a perspective view from the rear, and FIG. 12*g* a view from the rear.
Figure 12B:
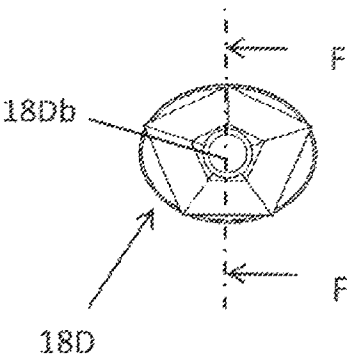
Figure 12C:
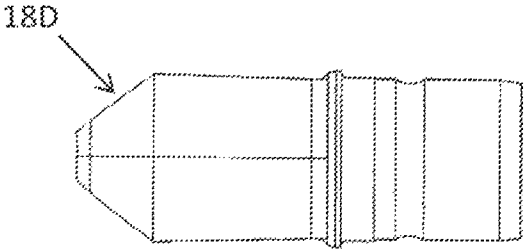
Figure 12D:
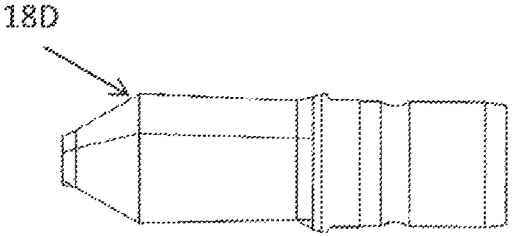
Figure 12E:
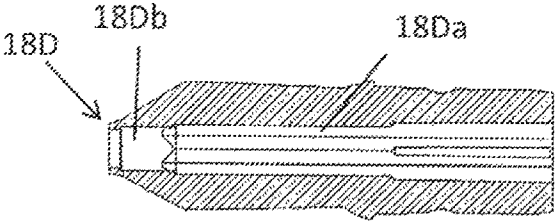
Figure 12F:
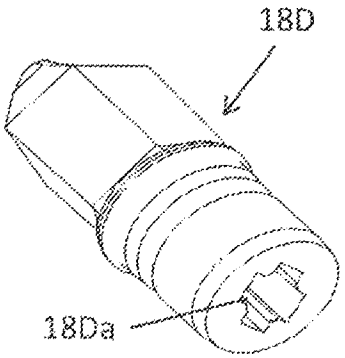
Figure 12G:
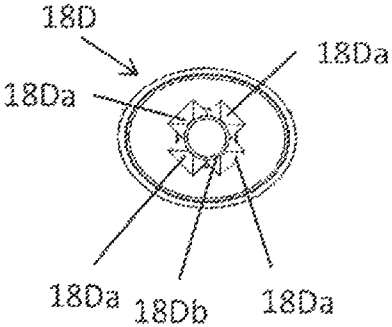

As shown in FIG. 12*b*, the supporting member 18D according to the fifth embodiment has a roughly pentagonal configuration, hence being horizontally asymmetrical when viewed from the front.

Referring to FIG. 13, the advantage of the supporting member 18D having a roughly pentagonal transverse cross-section to light refraction will be described.

FIG. 13*a* shows the supporting member 18C according to the fourth embodiment, whose transverse cross-section is both horizontally and vertically symmetrical. This supporting member 18C has a roughly elliptic outline defined by combination of line segments when viewed in transverse cross section, so that the top plane and bottom plane are arranged parallel. That is, as shown in FIG. 13*a*, parallel light rays L1 incident on the top plane on one side enter the interior as deflecting at the interface, propagate parallel to reach the bottom plane on the other side and go out from the bottom plane as deflecting at the interface (the light paths of light rays L1 are shown by broken lines). Since light rays L1, though being incident on, but pass through the supporting member 18C, the light is unlikely to contribute to glittering.

In contrast, the supporting member 18D according to the fifth embodiment has a pentagonal transverse cross section that is vertically asymmetrical, hence has no parallel planes, as shown in FIGS. 13*b*, 13*c* and 13*d*. As shown in FIG. 13*c*, the supporting member 180 having a pentagonal transverse cross-section is defined by individual planes 18D1 to 18D5. Parallel light rays L2 incident on the top plane 18D1 on one side enter the interior as deflecting at the interface 18D1 and are further reflected and refracted by lower planes 18D3 and 18D4 to be scattered upwards, and then goes out after repeated reflection and refraction by the planes 18D1 to 18D5 (the light paths of light rays L2 are shown toy broken lines).

Thus, formation of the supporting member 18D in a pentagonal external figure free from parallel planes makes it possible to increase the number of times of total internal reflection therein. As a result, light rays L2 entering the supporting member 18D bounce around on different planes and go out, producing sparkling glitter. In using the makeup tool, glitter of reflected light rays changes as the angle of entering light from the light source changes.

Further, though there is a cylindrical passage for application part 14D inside supporting member 18D as shown in FIG. 13*b*, it is possible to form the supporting member 18D in a pentagonal figure free from parallel planes. In addition to eliminating parallel planes, straight grooves (depressed portions) 18Da may be formed cross-wise along with the passage 18Db for the application part 14D inside support member 18D as forming cross-shaped core as shown in FIGS. 13*d* and 13*e*, whereby it is possible to further increase the frequency of total internal reflection, hence increase the brightness.

It is also possible to emphasize both the surface reflection and the total internal reflection by forming the supporting member 18B of a thicker transparent part while making the pen core thinner, as shown in FIGS. 11*a* to 13*e*.

When the supporting member 18D is formed of a material having a high Abbe value (producing low light dispersion), the member can give off cool light producing luxurious brilliance like a diamond. In this case, use of a material having a higher refractive index makes it easy to create both surface reflection and total internal reflection.

(Makeup Tool of the Sixth Embodiment)

Next, the makeup tool according to the sixth embodiment or the present invention will be described.

FIGS. 14*a*-14*d* show a makeup tool according to the sixth embodiment of the present invention, FIG. 14*a* a view from the front, FIG. 14*b* a perspective view, FIG. 14*c* a front view, and FIG. 14*d* a vertical cross section. FIGS. 15*a*-15J are apart diagram showing a supporting member (corresponding to "retainer") 18E of this makeup tool. FIG. 16 is an illustrative diagram showing a refraction state of light rays in the supporting member 18E.

Here, for a barrel cylinder 10, cosmetic absorbent 12 and front barrel 20 in FIGS. 14*a* to 16, the same components as those in the fourth and fifth embodiments are allotted with the same reference numerals.

Figure 15G:
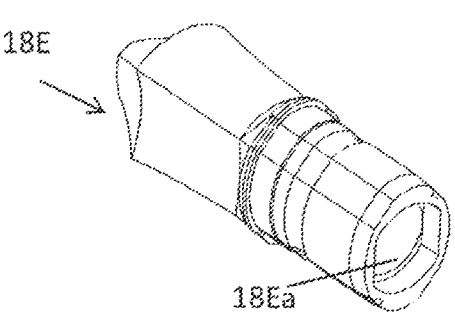
FIGS. 15*a* to 15*j* are part diagrams of a supporting member (retainer) in the makeup tool shown in FIGS. 14*a* to 14*d,* FIG. 15*a* showing a perspective view from the front, FIG. 15*b* a view from the front, FIG. 15*c* a transverse cross-sectional view cut along a plane D-D in FIG. 15*e,* FIG. 15*d* a plan view, FIG. 15*e* a front view, FIG. 15*f* a vertical cross section cut along a plane F-F in FIG. 15*b,* FIG. 15*g* a perspective view from, the rear, FIG. 15*h* a view from the rear, FIG. 15*i* a transverse cross-sectional view cut along a plane I-I in FIG. 15*e*, and FIG. 15*j* a transverse cross-sectional view cat along a plane J-J in FIG. 15*e,*
Figure 15H:
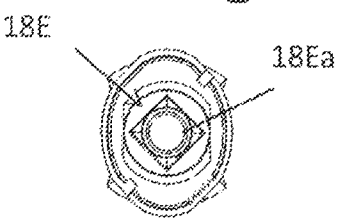
Figures 15I, 15J:
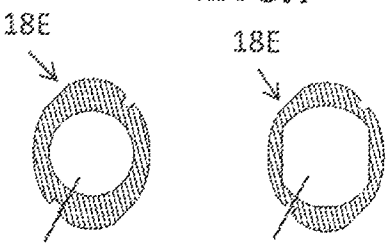
Figure 15D:
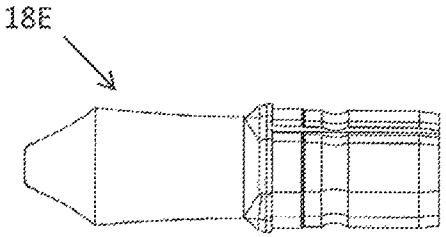
Figure 15E:
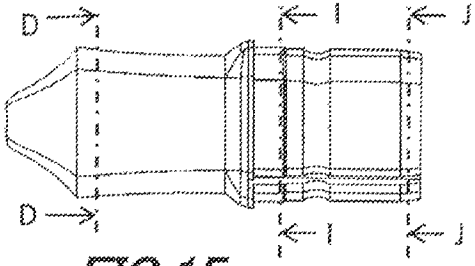
Figure 15F:
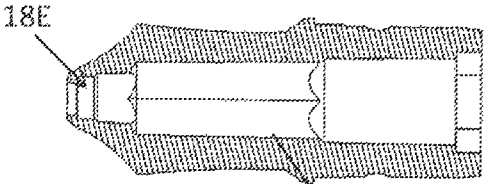
Figure 15A:
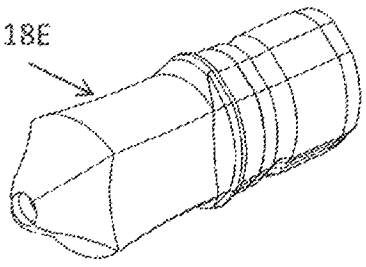
Figure 15B:
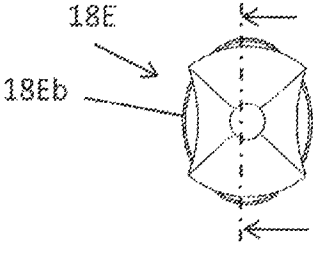
Figure 16:
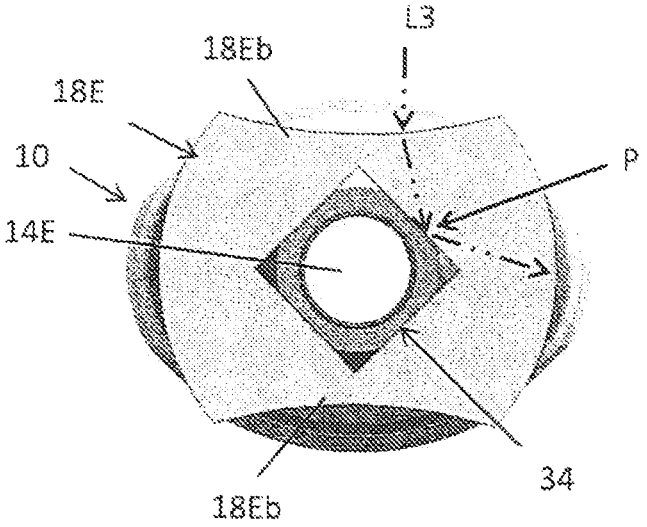
FIG. 16 is an illustrative diagram of a variational example of the makeup tool shown in FIGS. 14*a* to 14*d,* shown sectionally cut along the same plane C-C in FIG. 14*c* for explaining the light path through the supporting member.

As shown in FIGS. 14*a*, 14*b* and 15*b*, the supporting member 18E according to the sixth embodiment has a waisted form with a narrower middle section when viewed from the front, whereby the pen core of the application part 14E inside the supporting member 18E is made invisible from particular angles (stealth plastic base).

Figure 15C:
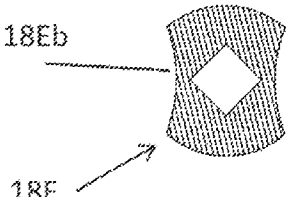

As shown in FIG. 15*c*, in the supporting member 18E, the core (i.e., the inner passage) of an inner passage 18Ea for an application part 14E is configured to have a square cross-section, whereby light rays undergo total internal reflection inside the supporting member 18E to thereby make the pen core of the application part 14E invisible.

Further, the supporting member 18E is shaped so as to have concavely arched external sides 18Eb, whereby light rays entering the supporting member 18E are easily refracted and made to undergo total internal reflection on the surface of inner passage 18Ea.

Moreover, provision of a metal pipe 34 between the supporting member 18E and the application part 14E as shown in FIG. 16, makes it possible to produce brilliance as if light rays were totally reflected even when the makeup tool is viewed from an angle that the pen core will be visible, by the function of reflection (the reflecting function thanks to total reflection and surface characteristics such as mirror reflection) of the outer surface of the metal pipe 34. As a result, it is possible to make the application part 14S (pen core) inside the supporting member 18E invisible from any direction of 360 degrees.

Use of a material with high refractive index for the supporting member 18E facilitates light to undergo total internal reflection, so that it is possible to extend the range of angles from which the pen core of the application part 14E can be bidden from view.

In an embodied product of the supporting member 18E, as shown in FIG. 16, since the concave side 18Eb produces a concave lens effect, incident light rays L3 within the range of ±12° relative to the incident light L3 (indicated by a dash and double-dot line L3) are totally reflected (at point P) so as to produce stealth effect, meaning that the pen core of the application part 14E becomes invisible. This is because the incident angle at the point P becomes greater hence the light is likely to be totally reflected.

In this case, insertion of the reflective pipe 34 in the inner passage 18Ea through which the application part 14E is placed, makes it possible to provide a structure that covers the pen core of the application part 14E by the pipe 34.

As a result, incident light 13 is reflected by the wall surface of the inner passage 18Ea (reflected in the interior of the supporting member 18E) and also reflected diffusely on the pipe 34 so that the whole of the application part 14E becomes unlikely to be seen or invisible. As the material of the pipe 34, reflective material such as metal is preferably used. Specifically, stainless steel, aluminum and nickel-chromium plated products are preferably used for the pipe 34.

As described above, according to the applicator of the sixth embodiment, since incident light is made to undergo total internal reflection inside the supporting member 18E, the application part 14E therein becomes invisible, improving stealth effect.

Accordingly, the user see reflection of light only without perceiving the application part 14E therein, so that this configuration provides brilliant impression. Further, provision of the pipe 34 can further improve the stealth effect.

(Makeup Tool of the Seventh Embodiment)

Next, the makeup tool according to the seventh embodiment of the present invention will toe described.

The makeup tool according to the seventh embodiment of the present invention has same configuration and external structure as that of the sixth embodiment. shown In FIGS. 14*a* to 16, so that no diagram is given. This embodiment is further improved in texture by improving light scattering using a different substance for the supporting member.

For the material of the supporting member, fine particles (of about some tens nanometers) are added to the transparent resin, whereby it is possible to generate blue color by Rayleigh scattering.

It is preferable in this configuration that the makeup container is constructed such that the ratio of the visible part of the content liquid feeder (the applying element such as pen core of the application part) to the surface area of the supporting member as the transparent member for the hard type pen tip, viewed from a particular angle, is equal to or less than 50%.

Further, it is preferable that the thickest part in the cross section perpendicular to the axis direction LD of the hard pen tip namely the transparent supporting member, is equal to or greater than 1 mm, and she ratio between the outside diameter of the feeder 14E (the pen core in the application part) and the outside diameter of the transparent part or supporting member is 1:3 or greater. That is, the outside diameter of transparent part is preferably equal to or greater than three times of the outside diameter of feeder 14E.

(Makeup Tool of the Eighth Embodiment)

Next, the makeup tool according to the eighth embodiment of the present invention will be described.

Figure 17:
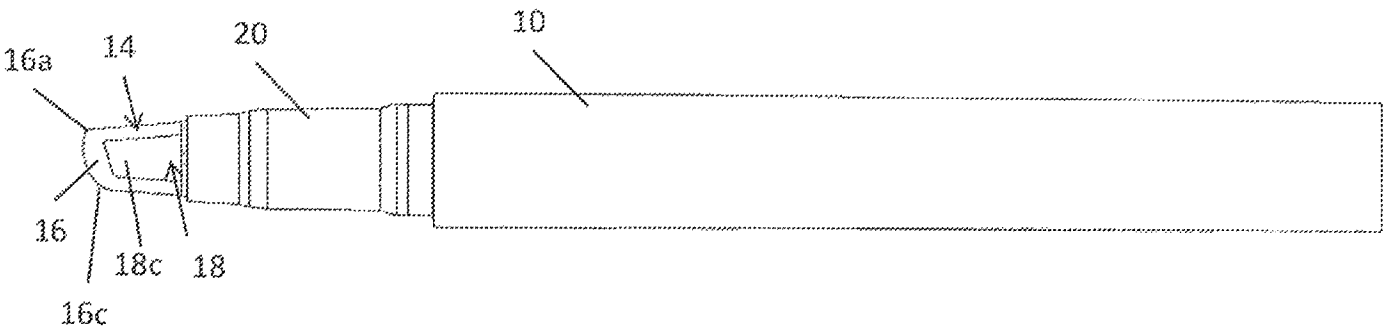
FIG. 17 is an illustrative diagram of a makeup tool according to an eighth embodiment of the present invention; and, FIGS. 18*a* to 18*h* are part diagrams of a cosmetic absorbent in the application part of the makeup tool shown in FIG. 17, FIG. 18*a* showing a perspective view, FIG. 18*b* a view from the front, FIG. 18*c* a view from the top, FIG. 18*d* a front view from the side, FIG. 18*e* a sectional view cut along a plane F-F in FIG. 18*c,* FIG. 18*f* a view from the bottom, FIG. 18*g* a view from the rear, and FIG. 18*h* an enlarged perspective view of the tip.
Figure 18A:
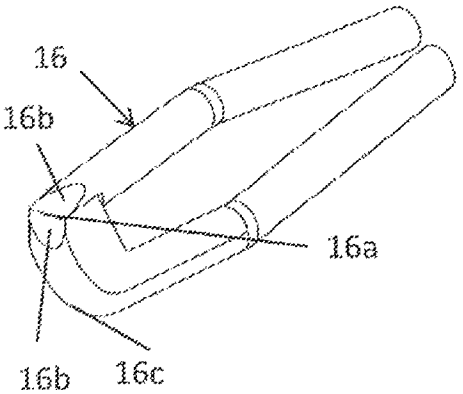
Figure 18C:
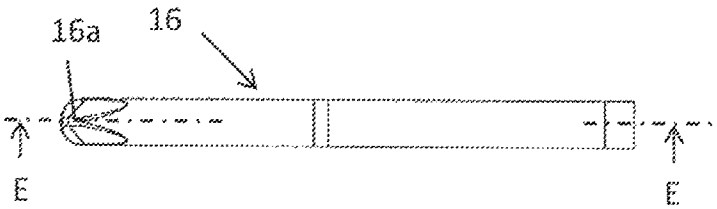
Figure 18D:
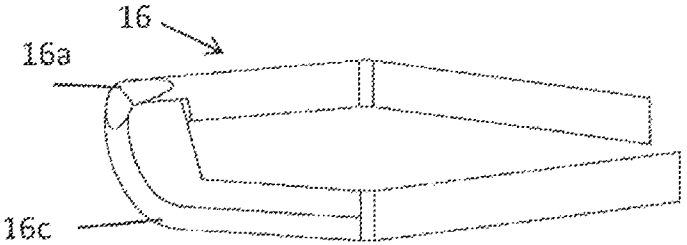
Figure 18B:
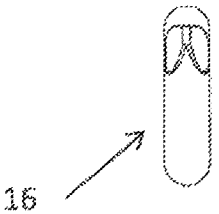
Figure 18G:
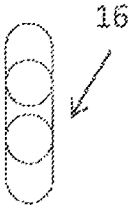
Figure 18H:
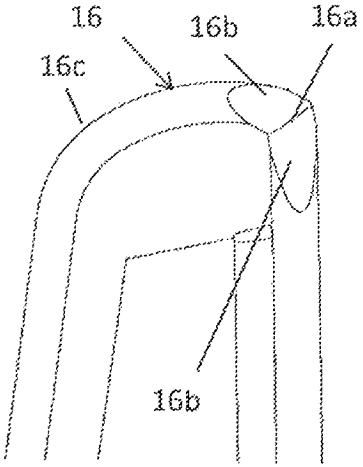
Figure 18E:
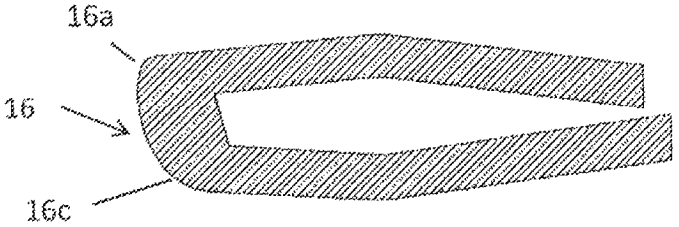
Figure 18F:
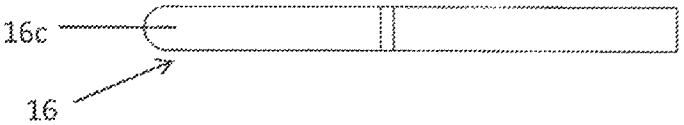

The makeup tool according to the eighth embodiment of the present invention has a structure shown in FIGS. 17 to 18*h*, which includes a cosmetic feeder(corresponding "applying element" or also called a pen core) of the application part 14, significantly different from that of the applicator of the first embodiment shown in FIGS. 1*a* to 3*h*. The other configurations are the same as those of the makeup tool of the first embodiment, so the same components are allotted with the same reference numerals.

In the makeup tool of the eighth embodiment, the cosmetic feeder 16 is formed so that the curvature of the curved portion 16*c* is made smaller than that of the first embodiment.

The cosmetic feeder 16 shown in FIGS. 18*a*-18*h* is formed with a greater circular arc compared to that of the curved portion 16*c* in the FIGS. 3*a*-3*h*. The front end (the section between the corners 16*a* to 16*c*) of the cosmetic feeder 16 has an atypical transverse cross section while the other part from the center to the rear has a circular transverse cross section.

As a result, the difference between an application width of the curved portion 16*c* and an application width of the corner 16*a* is emphasized, so that it is possible to create a makeup of variety. The other operation and effect are the same as that of the first embodiment.

In the above description of the embodiments, various configurations and structures have been illustrated. However, these are all mere examples, and it goes without saying that the present invention can take various kinds of configurations and structures. In the fifth embodiment, the supporting member is specified to have a pentagonal transverse cross section. However, the supporting member may have a polygonal transverse cross section other than hexagonal transverse cross section. Further, the supporting member may have a transverse cross section that varies in the axial direction.

In the makeup tool of the eighth embodiment, the cosmetic feeder 16 has an approximately circular transverse cross section and is formed with a filamentous shape and fitted around the supporting member 18. However, the cosmetic feeder may have an approximately polygonal transverse cross section.

INDUSTRIAL APPLICABILITY

The makeup tool of the present invention can be used for those that apply cosmetics such as liquid cosmetics, hair cosmetics, chemicals by way of an application part.

DESCRIPTION OF REFERENCE NUMERALS

10 barrel cylinder
12 cosmetic absorbent

14 application part (the first embodiment)
14A application part (the second embodiment)
14B application part (the third embodiment)
16 cosmetic feeder (applying element)
16A cosmetic feeder (applying element)
18 supporting member (retainer according to the first embodiment)
18A supporting member (retainer according to the second embodiment)
18B supporting member (retainer according to the third embodiment)
18C supporting member (retainer according to the fourth embodiment)
18D supporting member (retainer according to the fifth embodiment)
18E supporting member (retainer according to the sixth embodiment)
20 front barrel
22 porous applying element

What is claimed is:

1. A makeup tool comprising:
a barrel cylinder storing a cosmetic; and
an application part attached to one end of the barrel cylinder,
the application part comprising:
an applying element capable of feeding the cosmetic from the barrel cylinder to apply the cosmetic; and
a retainer that holds the applying element,
wherein
the retainer is formed of a transparent hard material or a translucent hard material,
the retainer is arranged so as to surround an outer surface of the applying element and an outside diameter of the retainer is equal to or greater than three times of an outside diameter of the applying element,
the retainer includes an inner passage with a surface, and the retainer is configured to totally internally reflect light on the surface of the inner passage such that the applying element becomes invisible due to the internal reflection, and
the retainer includes concavely arched external sides that are configured to provide a concave lens effect.

2. A makeup tool comprise:
a barrel cylinder storing a cosmetic; and
an application part attached to one of the barrel cylinder, the application part comprising:
an applying element capable of feeding the cosmetic from the barrel cylinder to apply the cosmetic; and
a retainer that holds the applying element,
wherein
the retainer is formed of a transparent hard material of a translucent hard material,
the applying element is arranged on an outer surface of the retainer along a longitudinal direction of the barrel cylinder,
a front end of the applying element has a curved portion, a flat portion, and a corner portion along a direction orthogonal to the longitudinal direction of the barrel cylinder,
the curved portion, the flat portion, and the corner portion are formed in the order of the foregoing on the front end, and
the front end of the applying element is formed in such a manner that the front end becomes narrower from the curved portion toward the corner portion along a ridge of the front end.

3. A makeup tool comprising:
a barrel cylinder storing a cosmetic; and
an application part attached to one of the barrel cylinder,
the application part comprising:
an applying element capable of feeding the cosmetic from the barrel cylinder to apply the cosmetic; and
a retainer that holds the applying element,
wherein
the retainer is formed of a transparent hard material or a translucent hard material,
the retainer is arranged so as to surround an outer surface of the applying element in a width direction,
an outer peripheral surface of the retainer is formed to a tapered shape toward a front end of the applying element, and
a tapered outer surface of the retainer is formed with raised ribs along a longitudinal direction of the barrel cylinder, the raised ribs being configured to magnify a user's view of the applying element through the retainer.

4. The makeup tool according to claim 1, wherein when the applying element is provided for the retainer and the retainer is viewed from a side of the retainer, a ratio of a visible part of the applying element to a surface area of the retainer is equal to or less than 50%.

* * * * *